US006232281B1

(12) United States Patent
Willey et al.

(10) Patent No.: US 6,232,281 B1
(45) Date of Patent: May 15, 2001

(54) SINGLET OXYGEN GENERATORS HAVING ENHANCED HEAVY ATOM EFFECT

(75) Inventors: Alan David Willey, Cincinnati, OH (US); Brian Jeffreys, Grimbergen; David William Ingram, Woluwe Saint-Lambergt, both of (BE)

(73) Assignee: Procter & Gamble Co., Cincinnati, OH (US)

( * ) Notice: Subject to any disclaimer, the term of this patent is extended or adjusted under 35 U.S.C. 154(b) by 0 days.

(21) Appl. No.: 09/355,155

(22) PCT Filed: Jan. 22, 1998

(86) PCT No.: PCT/US98/00222

§ 371 Date: Jul. 23, 1999

§ 102(e) Date: Jul. 23, 1999

(87) PCT Pub. No.: WO98/32824

PCT Pub. Date: Jul. 30, 1998

Related U.S. Application Data

(60) Provisional application No. 60/034,159, filed on Jan. 24, 1997.

(51) Int. Cl.[7] ..... C11D 3/395

(52) U.S. Cl. ..... 510/310; 510/367; 540/122; 540/128; 540/140

(58) Field of Search ..... 510/301, 367; 540/122, 128, 140

(56) References Cited

U.S. PATENT DOCUMENTS

| | | | | |
|---|---|---|---|---|
| 3,094,536 | | 6/1963 | Kenney et al. | 260/314.5 |
| 3,927,967 | | 12/1975 | Speakman | 8/103 |
| 4,033,718 | | 7/1977 | Holcombe et al. | 8/103 |
| 4,166,718 | | 9/1979 | Reinhart et al. | 8/111 |
| 4,240,920 | | 12/1980 | de Luque | 252/99 |
| 4,255,273 | | 3/1981 | Sakkab | 252/102 |
| 4,256,597 | | 3/1981 | Sakkab | 252/99 |
| 4,318,883 | | 3/1982 | Polony et al. | 422/22 |
| 4,368,053 | | 1/1983 | Eckhardt et al. | 8/102 |
| 4,400,173 | * | 8/1983 | Beavan | 8/107 |
| 4,497,741 | | 2/1985 | Hölzle et al. | 260/245.77 |
| 4,648,992 | * | 3/1987 | Graf et al. | 540/124 |
| 5,916,481 | * | 6/1999 | Willey | 252/186.21 |

FOREIGN PATENT DOCUMENTS

| | | | |
|---|---|---|---|
| 0 285965 | 10/1988 | (EP) | C09B/67/22 |
| 0 381211 | 8/1990 | (EP) | G11B/7/24 |
| 0 484027 | 5/1992 | (EP) | C09B/47/04 |
| 1372035 | 10/1974 | (GB) | D06L/3/04 |
| 1408144 | 1/1975 | (GB) | D06L/3/04 |
| 2159516 | 12/1985 | (GB) | C09B/47/04 |
| 6-73397 | 3/1994 | (JP) | C11D/3/395 |
| WO 91/18006 | 11/1991 | (WO) | C07J/43/00 |

OTHER PUBLICATIONS

Brasseur, N., et al., "Synthesis and Photodynamic Activities of Silicon 2,3–Naphthalocyanine Derivatives", J. Med. Chem., vol. 37, p. 415–420 (1994).

Cook, M.J. et al., "Octa–alkoxy Phthalocyanine and Naphthalocyanine Dertivatives: Dyes with Q–band Absorption in the Far Red or Near Infrared" J. Chem. Soc., Perkin Trans., vol. I., pp. 2453–2458 (1988).

Eberson, L., "Electron–Transfer Reactions in Organic Chemistry", Adv. Phys. Org. Chem., V. Gold/D. Bethell, Ed., vol. 18, pp. 79–185 (1982).

Esposito, J.N. et al., "The Synthesis and Physical Properties of Some Organo– and Organosiloxtsilicon Phthalocyanines", Inorg. Chem., vol. 5, No. 11, pp. 1979–1984 (Nov. 1966).

Ford, W.E. et al., "Synthesis and Photochemical Properties of Aluminum, Gallium, Silicon, and Tin Naphthalocyanines", Inorg. Chem., vol. 31, p. 3371–3377 (1992).

Hayashida, S., et al., "Effect of Axial Substituents on the Aggregate of Silicon Naphthalocyanine in the Vacuum Deposited Thin Films", Chem. Lett., pp. 2137–2140 (1990).

Joyner, R.D. et al, "Phthalocyaninosilicon Compounds", Inorg. Chem., vol. 1, No. 2, pp. 236–238 (May 1962).

Kavarnos, G. J., et a., "Photosensitization by Reversible Electron Transfer: Theories, Experimental Evidence, and Examples", Chem. Rev., vol. 86, pp. 401–449 (1986).

Kroenke, W.E. et al., "The Infrared Spectra of Some Tin and Lead Phthalocyanines", Inorg. Chem., vol. 3, No. 5, pp. 696–698 (May 1964).

Lopez, L., "Photoinduced Electron Transfer Oxygenations", Top. Current Chem., vol. 156, pp. 117–166 (1990).

Lowery, M.H. et al., "Dichloro(phthalocyanino)silicon", Inorg. Chem., vol. 4, p. 128 (1965).

Mariano, P.S., et al., "Synthetic Aspects of Photochemical Electron Transfer Reactions", Synthetic Organic Photochemistry, Wm. Horspool (Ed.) Plenum Press, NY, pp. 145–257 (1984).

Mattay, J., "Charge Transfer and Radical Ions in Photochemistry", Angew. Chem. Int. Ed. Engl, vol. 26, pp. 825–845 (1987).

Moyer, T. J., et al., "Iodine Doped $(SiNcO)_n$–A new Conducting Polymer", Polymer Preps, vol. 25, p. 234–235 (1986).

(List continued on next page.)

*Primary Examiner*—John Hardee
(74) *Attorney, Agent, or Firm*—Fay, Sharpe, Fagan, Minnich & McKee, LLP

(57) ABSTRACT

The present invention relates to photochemical singlet oxygen generators useful as bleaching agents for laundry detergent compositions or in hard surface cleaning compositions and as anti-microbials. The photochemical singlet oxygen generators comprise a heavy atom unit-containing axial unit wherein the heavy atoms overlap with the π electron cloud of the photosensitizer unit and enhance the quantum efficiency of the transition of an electron from exited singlet state to triplet state.

18 Claims, No Drawings

OTHER PUBLICATIONS

Parker, V.D., "Reaction Pathways of the Cation Radicals of Aromatic Compounds Related to the Anthracenes", Acc. Chem. Res., vol. 17, pp. 243–250 (1984).
Rafaeloff, R., et al., "New Group IV Phthalocyanines", J. Inorg. Nucl. Chem., vol. 28, pp. 899–902 (1966).
Wen, T–C., et al., "Synthesis and Photoproperties of Silicon Phthalocyanines and Silicon Naphthalocyanines", J. Chin. Chem. Soc., vol. 40, pp. 141–147 (1993).
Wheeler, B.L. et al., "A Silicon Phthalocyanine and a Silicon Naphthalocyanine; Synthesis, Electrochemistry, and Electrogenerated Chemiluminescence" J. Am. Chem. Soc., vol. 106, p. 7404–7410 (1984).
Witkiewic, Z. et al., "Properties of Octamethoxyphthalocyanines I. On their syntheses, electrical conductivity, and catalytic activity", Material Science, vol. 11, No. 1–2, pp. 39–45 (1976).

* cited by examiner

SINGLET OXYGEN GENERATORS HAVING ENHANCED HEAVY ATOM EFFECT

This Application Claims priority from U.S. Provisional Application No. 60/034,159, filed Jan. 24, 1997.

FIELD OF THE INVENTION

The present invention relates to photochemical singlet oxygen generators having an enhanced level of activity useful as photobleaches and as photo disinfectants. The compounds of the present invention achieve the enhanced photochemical activity by the interaction of the "heavy atom-containing" axial substituents with the photosensitizing ring.

BACKGROUND OF THE INVENTION

It is known that certain water-soluble phthalocyanine, naphthalocyanine, and metallocyanine compounds can be used as photobleaching and anti-microbial agents. Phthalocyanines and naphthalocyanines or their metal complexes can form "singlet oxygen" an oxidative species capable of reacting with stains to bleach them to a colorless and usually water-soluble state.

There are many examples of phthalocyanines and naphthalocyanines photobleaches, the most common being the zinc and aluminum phthalocyanines. In the literature the term "photosensitizer" is often used instead of "photoactivator" and may therefore be considered as standing equally well for the latter term used throughout this specification.

The prior art teaches phthalocyanine and naphthalocyanine compounds having the general structure

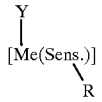

where Me is a transition or non-transition metal, (Sens.) is a phthalocyanine or naphthalocyanine ring which, when combined with a suitable Me unit, is capable of undergoing photosensitization of oxygen molecules, R units are substituent groups which are bonded to the photosensitization ring units (Sens.) to enhance the solubility or photochemical properties of the molecule, and Y units are substituents associated with the metal atom, for example, anions to provide electronic neutrality. The selection of a particular substituent R unit for substitution into the molecule has been the focus of many years of research and these units are typically chosen by the formulator to impart into the target molecule the desired level of water solubility.

It has been a task of formulators of photobleaches to modify the properties of the (Sens.) unit of the molecule to increase the quantum efficiency without reducing the water solubility. While balancing water solubility and enhanced photophysics, the formulator must insure that the structural modifications do not increase the color.

Surprisingly, it has been found that the compounds of the present invention allow the formulators to increase the photoefficiency of the photoactive compounds without adversely affecting the other parameters of the molecule. This ability to delineate and selectively modify the key structural elements contributing to the target properties of the molecule allows the formulator to proceed without having to rely upon a "hit and miss" stratagem.

The photobleaches of the invention comprise a photosensitizing ring which chelates a photoactive metal or non-metal. To this photoactive metal or non-metal is attached a photo activating ligand which enhances the photoefficiency of the molecule via the "heavy atom effect". In addition to the photoactivating ligand, the photobleaches of the present invention also comprise an axial group which mediates solubility and substantivity of the molecule.

It is therefore an object of the present invention to provide photochemical singlet oxygen generators which serve as photobleaches and photodisinfectants. It is a further object of the present invention to provide photobleaching compositions suitable for use as laundry detergent bleaching compositions.

It is a yet further object of the present invention to provide enhanced photobleaching hard surface cleaning compositions for non-porous hard surfaces, inter alia, Formica®, ceramic tile, glass, or for porous hard surfaces such as concrete or wood.

It is a still further object of the present invention is to provide a method for bleaching fabric with laundry compositions comprising the photobleaching compounds of the present invention.

It is yet still a further object of the present invention is to provide a method for cleaning hard surfaces with the photobleaching compounds of the present invention.

BACKGROUND ART

The following references relate to various aspects of photochemical processes encompassed within the present invention: *Chem. Rev.,* Kavarnos G. J., Turro N. J., 86, pg. 401, (1986); *Angew. Chem. Int. Ed. Eng.,* Mattay J., 26, pg. 825, (1987); *Adv. Phys. Org. Chem.,* Eberson L., 18, pg. 79, (1987); *Top. Current Chem.,* Lopez, L., 156, pg. 117 (1990); *Adv. Photochem.,* Fox, M. S., 13, pg. 237, (1986); "Synthetic Organic Photochemistry", Horspool W. M. (ed); Mariano, P. S., pg. 145, (1984), Plenum Press, New York; "Organic Photochemistry", Padwa, A. (ed); Mattes, S. L. and Farid, S., 6, pg. 233, (1983); *Accounts of Chemical Research,* Parker, V. D., 17, pg. 243, (1984).

SUMMARY OF THE INVENTION

The present invention relates to photochemical singlet oxygen generators having the formula:

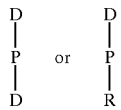

wherein P is a photosensitizing unit; each D is independently a unit having the formula:

$$—L^1—R$$

wherein $L^1$ is $C_1$–$C_{20}$ linear or branched alkylene, $C_1$–$C_{20}$ linear or branched alkenylene, $C_6$–$C_{20}$ substituted or unsubstituted arylene, $C_6$–$C_{20}$ substituted or unsubstituted aryleneoxy, $C_7$–$C_{30}$ linear or branched alkylenearylene; provided $L^1$ is substituted within 10 covalent bonds of the photosensitizing unit by at least one heavy atom, said heavy atom selected from the group consisting of chlorine, bromine, iodine, and mixtures thereof; and optionally R is an axial moiety which mediates the solubility or substantivity of the singlet oxygen generator.

The present invention also relates to laundry detergent and hard surface cleaning compositions which comprise at least about 0.01% of the photoactive singlet oxygen generators of the present invention.

All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

The present invention relates to photochemical singlet oxygen generators useful for photochemical bleaching, photochemical disinfecting, and photochemical purification of fabric or hard surfaces. The photochemical singlet oxygen generators described herein produce singlet oxygen molecules at an enhanced efficiency due to the interaction of certain "heavy atoms" with the π electron cloud of the photosensitizer unit. The axial group which contains the "heavy atoms" also serves to tether these atoms in a manner which allows for efficient interaction between heavy atom and photosensitizer unit. In addition the tether is optionally linked to a group capable of mediating the solubility or substantivity of the molecule as a whole.

The singlet oxygen generators of the present invention have the formula:

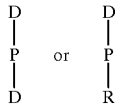

and comprise:

a) a photosensitizing group;

b) a photoactive metal or non-metal chelated by said photosensitizing group;

c) at least one photochemical mediating axial moiety bonded to said photoactive metal or non-metal, said photochemical mediating axial moiety comprises at least one heavy atom within ten covalent bonds of the point of attachment of said photochemical mediating axial moiety to said photoactive metal or non-metal, said heavy atom selected from the group consisting of chlorine, bromine, iodine, and mixtures thereof; and d) one or more axial moieties which mediate the solubility or substantivity of the singlet oxygen generator molecule, said solubility or substantivity mediating axial moiety is bonded directly to said photoactive metal or non-metal, or to the photochemical mediating axial moiety at the end distal to the photosensitizing group.

For the purposes of the present invention substituted aryl units are defined as moieties having the formula:

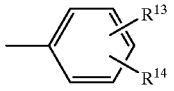

wherein $R^{13}$ and $R^{14}$ are independently selected from the group consisting of hydrogen, $C_1$–$C_6$ alkyl, $C_2$–$C_6$ alkenyl, $C_1$–$C_6$ alkoxy, $C_3$–$C_6$ branched alkoxy, halogen, morpholino, cyano, nitrilo, $—CO_2^-M^+$, $—SO_3^-M^+$, $—OSO_3^-M^+$, $—N(R^{15})_2$, and $—N^+(R^{15})_3X^-$ wherein each $R^{15}$ is independently hydrogen or $C_1$–$C_4$ alkyl; and mixtures thereof; wherein M is a water soluble cation and X is chlorine, bromine, iodine, or other water soluble anion. Examples of other water soluble anions include organic species such as fumarate, tartrate, oxalate and the like, inorganic species include sulfate, hydrogen sulfate, phosphate and the like.

For the purposes of the present invention substituted alkylaryl units are defined as moieties having the formula:

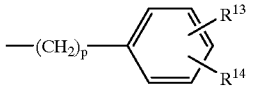

wherein $R^{13}$ and $R^{14}$ are the same as define above, p is from 1 to about 10.

For the purposes of the present invention substituted aryloxy units are defined as moieties having the formula:

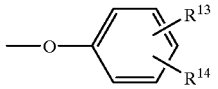

wherein $R^{13}$ and $R^{14}$ are the same as define above.

For the purposes of the present invention substituted aryloxyalkyl units are defined as moieties having the formula:

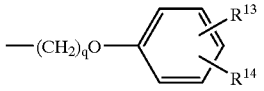

wherein $R^{13}$ and $R^{14}$ are the same as define above, q is from 0 to about 10.

For the purposes of the present invention substituted alkoxyaryl units are defined as moieties having the formula:

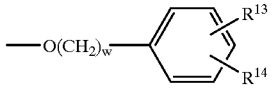

wherein $R^{13}$ and $R^{14}$ are the same as define above, w is from 1 to about 10.

For the purposes of the present invention both substituted and un-substituted aryl, alkylaryl, aryloxy and aryloxyalkyl have the indices p, q, and w as defined herein above, however aryl, alkylaryl, aryloxy and aryloxyalkyl units comprise $R^{13}$ and $R^{14}$ units that are both hydrogen. For example, aryl is unsubstituted phenyl, naphthyl, thienyl, pyridinyl, etc.

For the purposes of the present invention substituted alkyl units are defined as moieties having the formula $$—(A)_v—(CH_2)_yZ$$

wherein A is the heteroatom nitrogen or oxygen, preferably A is oxygen, the index v is 0 when the heteroatom is absent, v is equal to 1 when the heteroatom is present, Z is hydroxy, nitrilo, cyano, $C_1$–$C_6$ alkoxy, aryl; substituted aryl, aryloxy, and substituted aryloxy as defined above; alkyleneamino as further defined herein below; hydroxyl, $—SO_3^-M^+$, —$OSO_3^-M^+$, —$CO_2H$, —$N(R^{15})_2$, and mixtures thereof; wherein $R^{15}$ is $C_1$–$C_4$ alkyl, $C_1$–$C_4$ hydroxy alkyl, and mixtures thereof; M is a water soluble cation; y is from 0 to 22.

For the purposes of the present invention ethyleneoxy units are defined as moieties having the formula:

$$—(OCH_2CH_2)_xZ$$

wherein Z is hydrogen, $C_1$–$C_6$ alkoxy, aryl, substituted aryl, aryloxy, substituted aryloxy, alkyleneamino, —$SO_3^-M^+$, —$OSO_3^-M^+$, —$CO_2H$, and mixtures thereof; x is from 1 to 100.

For the purposes of the present invention alkylethyleneoxy units are defined as moieties having the formula:

$$—(A)_v—(CH_2)_y(OCH_2CH_2)_xZ$$

wherein A is the heteroatom nitrogen or oxygen, preferably A is oxygen, the index v is 0 when the heteroatom is absent, v is equal to 1 when the heteroatom is present, Z is hydrogen, $C_1$–$C_6$ alkoxy, aryl, substituted aryl, aryloxy, substituted aryloxy, alkyleneamino, —$SO_3^-M^+$, —$OSO_3^-M^+$, —$CO_2H$, and mixtures thereof; x is from 1 to 100 and y is from 1 to 12.

For the purposes of the present invention alkyleneamino units are defined as moieties having the formula:

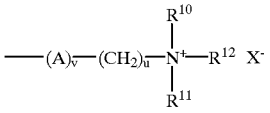

wherein $R^{10}$, and $R^{11}$ are each a $C_1$–$C_{22}$ alkyl, $C_3$–$C_{22}$ branched alkyl, $C_2$–$C_{22}$ alkenyl, $C_3$–$C_{22}$ branched alkenyl, $R^{12}$ is hydrogen, $C_1$–$C_{22}$ alkyl, $C_3$–$C_{22}$ branched alkyl, $C_2$–$C_{22}$ alkenyl, $C_3$–$C_{22}$ branched alkenyl and mixtures thereof, A is the heteroatom nitrogen or oxygen, preferably A is oxygen, the index v is 0 when the heteroatom is absent, v is equal to 1 when the heteroatom is present, X is chloride, bromide, iodide, or other water soluble anion, u is from 0 to 22. Examples of other water soluble anions include organic species such as fumarate, tartrate, oxalate and the like, inorganic species include sulfate, hydrogen sulfate, phosphate and the like.

For the purposes of the present invention amino units are defined as moieties having the formula:

$$—NR^{17}R^{18}$$

wherein $R^{17}$ and $R^{18}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof.

For the purposes of the present invention $C_1$–$C_{20}$ linear or branched alkylene moieties are defined as units having the formula:

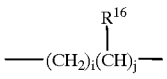

wherein $R^{16}$ is $C_1$–$C_4$ alkyl, chlorine, bromine, or iodine; the index i has the value from 1 to 18, the index j has the value from 1 to 18, and the value of i+j can not exceed 20. When the $C_1$–$C_{20}$ linear or branched alkylene moieties comprise photochemical mediating axial moieties the heavy atoms chlorine, bromine, and iodine must be substituted at a carbon atom within ten covalent bonds of the proximal end of the alkylene moiety, said proximal end is connected to the photoactive metal or non-metal.

For the purposes of the present invention $C_1$–$C_{20}$ substituted or unsubstituted arylene moieties are defined as 1,2-phenylene, 1,3-phenylene, and 1,4-phenylene units having the formula:

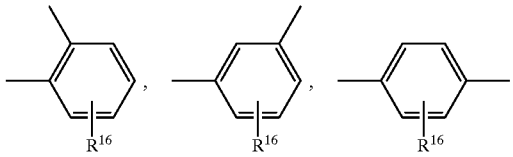

wherein $R^6$ is hydrogen, $C_1$–$C_4$ alkyl, chlorine, bromine, iodine, and mixtures thereof. When the $C_1$–$C_{20}$ substituted or unsubstituted arylene moieties comprise photochemical mediating axial moieties the heavy atoms chlorine, bromine, and iodine must be substituted at a carbon atom within ten covalent bonds of the proximal end of the arylene moiety, said proximal end is connected to the photoactive metal or non-metal.

For the purposes of the present invention $C_7$–$C_{20}$ substituted or unsubstituted alkylenearylene moieties are defined as 1,2-phenylene, 1,3-phenylene, and 1,4-phenylene units having the formula:

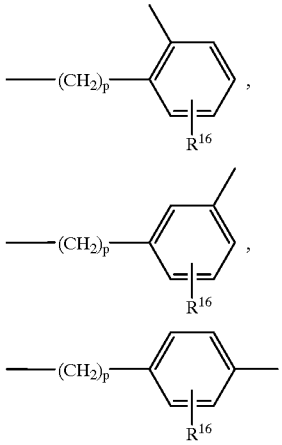

wherein $R^{16}$ is hydrogen, $C_1$–$C_4$ alkyl, chlorine, bromine, iodine, and mixtures thereof, the index p has the value from 1 to 24. When the $C_7$–$C_{30}$ substituted or unsubstituted alkylenearylene moieties comprise photochemical mediating axial moieties the heavy atoms chlorine, bromine, and iodine must be substituted at a carbon atom within ten covalent bonds of the proximal end of the alkylenearlyene moiety, said proximal end is connected to the photoactive metal or non-metal.

For the purposes of the present invention $C_6$–$C_{20}$ substituted and unsubstituted aryleneoxy moieties are defined as 1,2-phenyleneoxy, 1,3-phenyleneoxy, and 1,4-phenyleneoxy units having the formula:

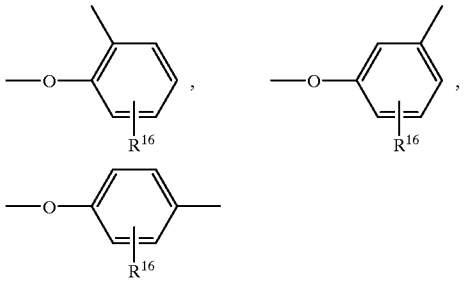

wherein $R^{16}$ is hydrogen, $C_1$–$C_4$ alkyl, chlorine, bromine, iodine, and mixtures thereof. When the $C_6$–$C_{20}$ substituted and unsubstituted aryleneoxy moieties comprise photochemical mediating axial moieties the heavy atoms chlorine, bromine, and iodine must be substituted at a carbon atom within ten covalent bonds of the proximal end of the aryleneoxy moiety, said proximal end is connected to the photoactive metal or non-metal.

Photosensitizing Groups

The singlet oxygen generators of the present invention comprise a photosensitizer group. Preferred photosensiting groups P are the cyanines. The cyanine photosensitizing groups include phthalocyanines, naphthalocyanines, mixed cyanines as well as other aromatic photosensitizing units described herein below. The photosensitizing groups are combined with a photoactive metal or non-metal to produce a metallocyanine photosensitizer.

When the photosensitizing group P is a cyanine ring said ring has the formula:

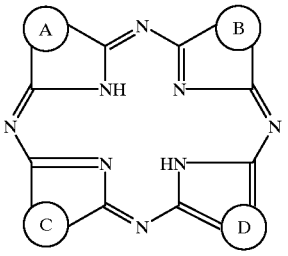

wherein rings A, B, C, and D are aromatic rings independently selected from the group consisting of substituted and unsubstituted benzene, substituted and unsubstituted naphthalene, substituted and unsubstituted anthracene; substituted and unsubstituted phenanthrene, and mixtures thereof.

For the purposes of the present invention cyanine ring components derived from substituted and unsubstituted benzene can be written in either of two equivalent resonance formulas:

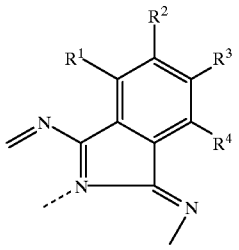

or

-continued

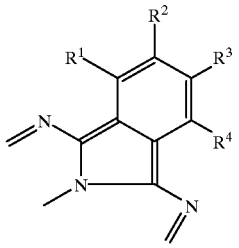

wherein $R^1$, $R^2$, $R^3$ and $R^4$ are each independently selected from the substituents described herein below.

For the purposes of the present invention cyanine ring components derived from substituted and unsubstituted 2,3-naphthylene can be written in either of two equivalent resonance formulas:

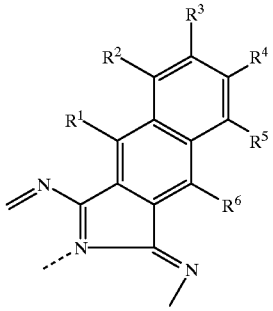

or

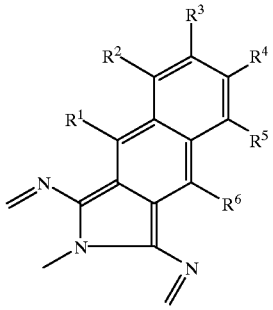

wherein $R^1$, $R^2$, $R^3$, $R^4$, $R^5$, and $R^6$ are independently selected from the substituents described herein below.

For the purposes of the present invention cyanine ring components derived from substituted and unsubstituted 1,2-naphthylene can be written in either of two equivalent resonance formulas:

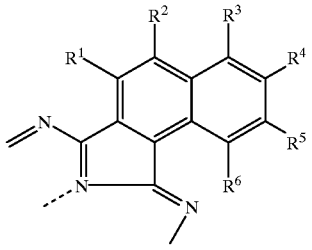

or

-continued

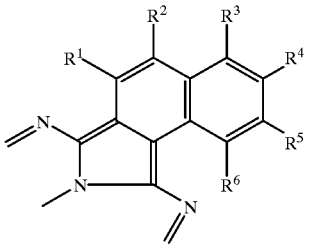

wherein $R^1$, $R^2$, $R^3$, $R^4$, $R^5$, and $R^6$ units are independently selected from the substituents listed herein below.

For the purposes of the present invention cyanine ring components derived from substituted and unsubstituted anthracene can be written in either of two equivalent resonance formulas:

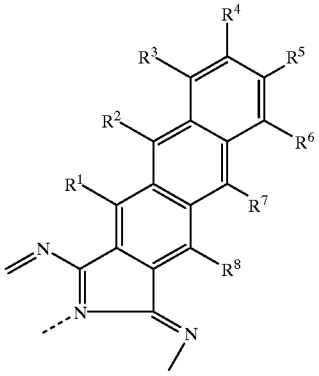

or

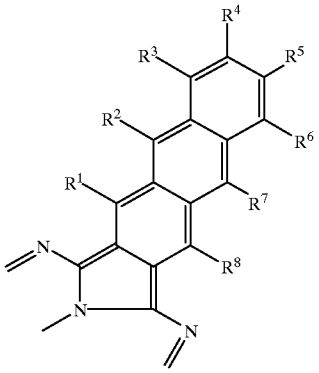

wherein $R^1$, $R^2$, $R^3$, $R^4$, $R^5$, $R^6$, $R^7$, and $R^8$ units are independently selected from the substituents described herein below.

For the purposes of the present invention cyanine ring components derived from substituted and unsubstituted phenanthrene can be written in either of two equivalent resonance formulas:

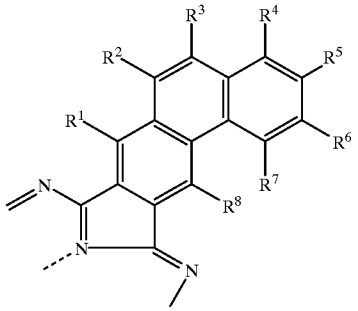

or

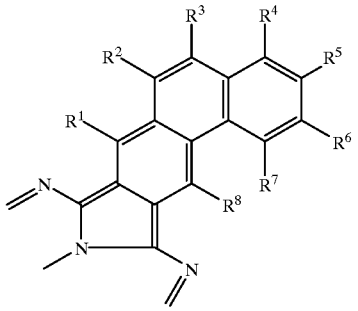

wherein $R^1$, $R^2$, $R^3$, $R^4$, $R^5$, $R^6$, $R^7$, and $R^8$ units are independently selected from the substituents described herein below.

For the purposes of the present invention each $R^1$, $R^2$, $R^3$, $R^4$, $R^5$, $R^6$, $R^7$, and $R^8$ unit is independently selected from the group consisting of:

a) hydrogen;

b) halogen;

c) hydroxy;

d) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

e) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

f) polyhydroxyl substituted $C_3$–$C_{22}$ alkyl;

g) $C_1$–$C_{22}$ alkoxy;

h) branched alkoxy having the formula:

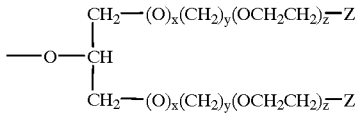

or

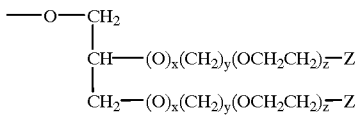

wherein Z is hydrogen, hydroxyl, $C_1$–$C_{30}$ alkyl, $C_1$–$C_{30}$ alkoxy, $—CO_2H$, $—OCH_2CO_2H$, $—SO_3^-M^+$, $—OSO_3^-M^+$, $—PO_3^{2-}M$, $—OPO_3^{2-}M$, or mixtures thereof; M is a water soluble cation in sufficient amount to satisfy charge balance; x is 0 or 1, each y independently has the value from 0 to 6, each z independently has the value from 0 to 100;

i) substituted aryl, unsubstituted aryl, or mixtures thereof;

j) substituted alkylenearyl, unsubstituted alkylenearyl, or mixtures thereof;

k) substituted aryloxy, unsubstituted aryloxy, or mixtures thereof;

l) substituted oxyalkylenearyl, unsubstituted oxyalkylenearyl, or mixtures thereof;

m) substituted alkyleneoxyaryl, unsubstituted alkyleneoxyaryl, or mixtures thereof;

n) $C_1$–$C_{22}$ thioalkyl, $C_3$–$C_{22}$ branched thioalkyl, or mixtures thereof;

o) an ester of the formula $—CO_2R^9$ wherein $R^9$ is i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

iii) polyhydroxyl substituted $C_3$–$C_{22}$ alkylene;

iv) $C_3$–$C_{22}$ glycol;

v) $C_1$–$C_{22}$ alkoxy;

vi) $C_3$–$C_{22}$ branched alkoxy;

vii) substituted aryl, unsubstituted aryl, or mixtures thereof;

viii) substituted alkylenearyl, unsubstituted alkylenearyl, or mixtures thereof;

ix) substituted aryloxy, unsubstituted aryloxy, or mixtures thereof;

x) substituted oxyalkylenearyl, unsubstituted oxyalkylenearyl, or mixtures thereof;

xi) substituted alkyleneoxyaryl, unsubstituted alkyleneoxyaryl, or mixtures thereof;

p) an alkyleneamino unit of the formula:

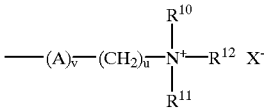

wherein $R^{10}$ and $R^{11}$ are $C_1$–$C_2$ alkyl, $C_3$–$C_{22}$ branched alkyl, $C_2$–$C_{22}$ alkenyl, $C_3$–$C_{22}$ branched alkenyl, or mixtures thereof;

$R^{12}$ is:

i) hydrogen;

ii) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

A is nitrogen or oxygen; X is chlorine, bromine, iodine, or other water soluble anion, v is 0 or 1, u is from 0 to 22;

q) an amino unit of the formula:

$$—NR^{17}R^{18}$$

wherein $R^{17}$ and $R^{18}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

r) an alkylethyleneoxy unit of the formula:

$$—(A)_v—(CH_2)_y(OCH_2CH_2)_xZ$$

wherein Z is:

i) hydrogen;

ii) hydroxyl;

iii) $—CO_2H$;

iv) $—SO_3^-M^+$;

v) $—OSO_3^-M^+$;

vi) $C_1$–$C_6$ alkoxy;

vii) substituted aryl, unsubstituted aryl, or mixtures thereof;

viii) substituted aryloxy, unsubstituted aryloxy, or mixtures thereof;

ix) alkyleneamino; or mixtures thereof;

A is nitrogen or oxygen, M is a water soluble cation, v is 0 or 1, x is from 0 to 100, y is from 0 to 12;

s) substituted siloxy of the formula:

$$—OSiR^{19}R^{20}R^{21}$$

wherein each $R_{19}$, $R^{20}$, and $R^{21}$ is independently i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) substituted aryl, unsubstituted aryl, or mixtures thereof;

iii) substituted aryloxy, unsubstituted aryloxy, or mixtures thereof;

iv) an alkylethyleneoxy unit of the formula:

$$—(A)_v—(CH_2)_y(OCH_2CH_2)_xZ;$$

wherein Z is:

a) hydrogen;

b) hydroxyl;

c) $—CO_2H$;

d) $—SO_3^-M^+$;

e) $—OSO_3^-M^+$;

f) $C_1$–$C_6$ alkoxy;

g) substituted aryl, unsubstituted aryl, or mixtures thereof;

h) substituted aryloxy, unsubstituted aryloxy, or mixtures thereof;

i) alkyleneamino; or mixtures thereof;

A is nitrogen or oxygen, M is a water soluble cation, v is 0 or 1, x is from 0 to 100, y is from 0 to 12; or mixtures thereof; and mixtures thereof;

A non-limiting example of the photosensitizing ring P is the unsubstituted phthalocyanine moiety having the formula:

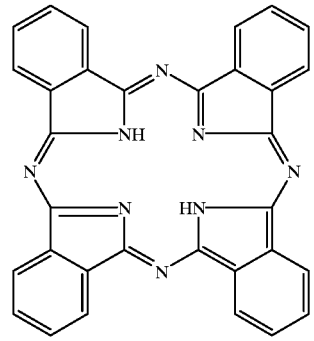

wherein the $R^1$, $R^2$, $R^3$, and $R^4$ units of each benzene ring is a hydrogen atom.

A further example of the photosensitizing ring P is the unsubstituted 2,3-naphthalocyanine moiety having the formula:

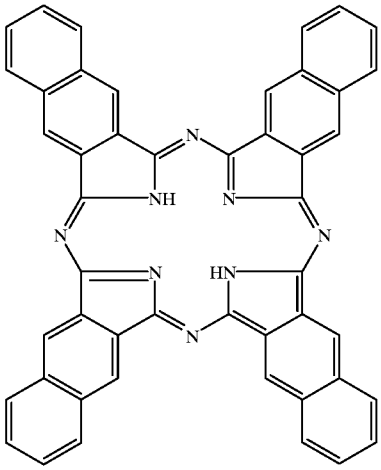

wherein the $R^1$, $R^2$, $R^3$, $R^4$, $R^5$, and $R^6$ units of each naphthylene ring is a hydrogen atom.

However, the photosensitizing ring can comprise more than one type of substituted or unsubstituted unit. This mixture of units results in the formation of a hybrid cyanine photosensitizing group. A non-limiting example of a "hybrid cyanine" or "mixed cyanine" ring system is the unsubstituted (3)-benzene-(1)-naphthalene ring having the formula:

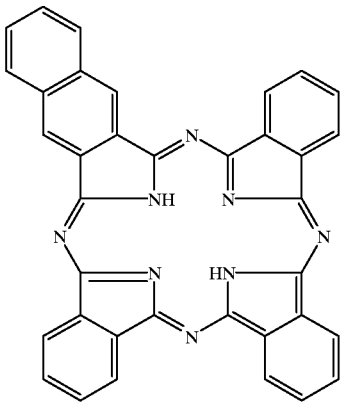

wherein the $R^1$, $R^2$, $R^3$, and $R^4$ units of each of the benzene rings is a hydrogen atom, and the $R^1$, $R^2$, $R^3$, $R^4$, $R^5$, and $R^6$ units of the naphthylene ring is a hydrogen atom.

The term "hybrid cyanine" is taken to encompass all the reaction products formed when two or more different monomers are reacted together. Those of ordinary skill in the art will recognize the resulting mixture of two or more different monomers will comprise both hybrid as well as non-hybrid cyanine rings. However, for the purposes of the present invention the term "hybrid cyanines" is taken to encompass all reaction products resulting from two or more different monomers. It is recognized that as the number of different monomers increases, the number of possible hybrid rings and non-hybrid rings capable of being formed also increases.

As indicated above, the "hybrid cyanines" can be formed from two or more monomers. In addition, the stoichiometric ratio of the monomers can be varied to provide mixtures having different ratios of ring components. The following provides non-limiting examples of reactions to form mixed cyanines.

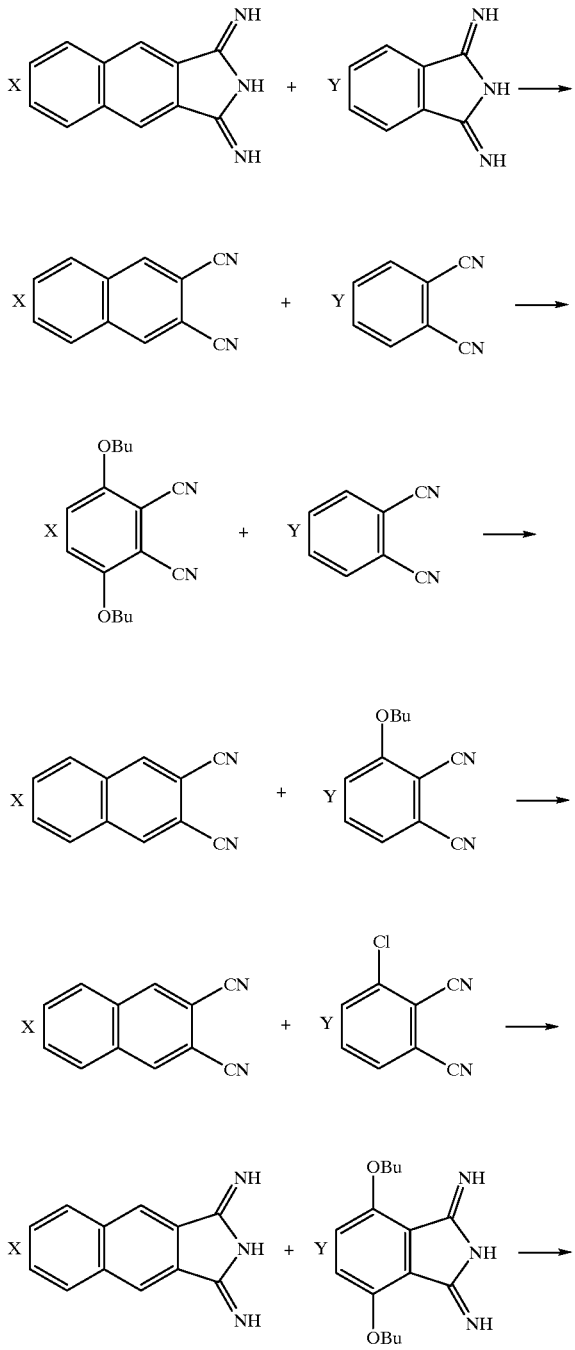

wherein the ratio of the indices x and y indicate the stoichiometric amounts of each reacant, said reactant ratios can range from 0.01 to 100, that is the value of x can be 1 when the value of y is 100 and the value of x can be 100 when the value of y is 1. For example, the following formula

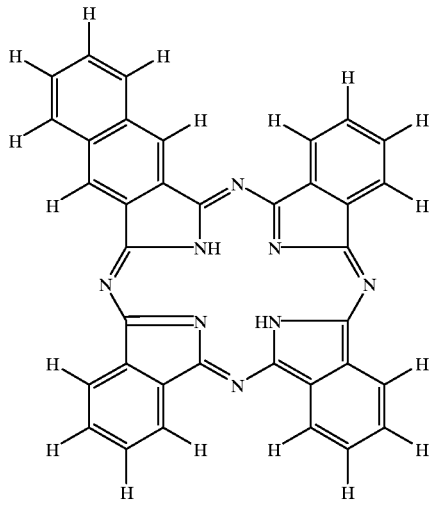

is a major product from the following reaction stoichiometry

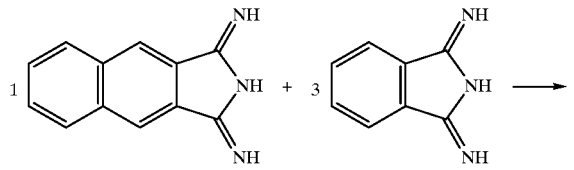

Further suitable photosensitizing group are the porphyrins and metalloporphyrins having the formula:

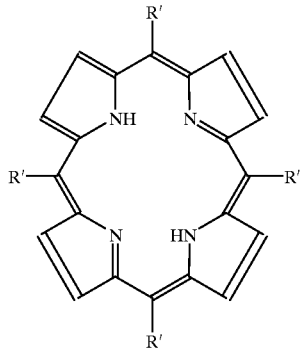

wherein R' is aryl, substituted aryl, and mixtures thereof, as defined herein above.

Photoactive Metals or Non-metals

The photochemical singlet oxygen generators of the present invention comprise a photoactive metal or non-metal M which is chelated by the photosensitizing group described herein above. Preferred photoactive metals or non-metals include silicon, aluminum, phosphorous, platinum, palladium, tin, lead, and germanium. The photoactive metals or non-metals are further bonded to a photochemical mediating axial moiety having one or more heavy atoms, and optionally to a solubility or substantivity mediating axial moiety R.

Photochemical Mediating Axial Moiety (PMAM)—Tethers Comprising Heavy Atoms

The photochemical singlet oxygen generators of the present invention are molecules which comprise one or more Photochemical Mediating Axial Moieties (PMAM) containing heavy atoms which interact with the molecule's photosensitizing group P to produce an enhanced efficiency for singlet oxygen generation.

The PMAM is represented by the symbol D. Each D is independently a unit having the formula:

$$—L^1—R$$

wherein $L^1$ is $C_1$–$C_{20}$ linear or branched alkylene, $C_1$–$C_{20}$ linear or branched alkenylene, $C_6$–$C_{20}$ substituted or unsubstituted arylene, $C_6$–$C_{20}$ substituted or unsubstituted aryleneoxy, $C_7$–$C_{30}$ linear or branched alkylarylene, provided $L^1$ is substituted within 10 covalent bonds of the photoactive metal or non-metal M by at least one heavy atom, said heavy atom selected from the group consisting of chlorine, bromine, iodine, and mixtures thereof. Each D unit is covalently bonded at its proximal end to a photoactive metal or non-metal, said metal or non-metal chelated by the photosensitizing group. The distal end of the moiety D is comprised of an R unit, therefore each $L^1$ unit is bonded at its distal end to an R unit which is further defined herein below. D units serve as a tether thereby placing the heavy atoms of the photochemical mediating moiety in a position proximal to the photosensitizing group wherein the heavy atoms can interact with the photosensitizing group.

For the purposes of the present invention the term "photochemical mediating axial moiety" (PMAM) is defined as "a moiety which is bonded to a photoactive metal or non-metal which is in turn chelated to a photosensitizing group as defined herein, wherein the photochemical mediating axial moiety comprises a linear or branched alkylene, substituted or unsubstituted arylene, substituted or unsubstituted aryleneoxy, or linear or branched alkylenearylene unit as defined herein above, provided said PMAM unit comprises at least one chlorine, bromine, or iodine atom bonded to said PMAM unit within the first ten covalent bonds from the point where the PMAM is bonded to said photoactive metal or non-metal". The term "photochemical mediating axial moiety" or "PMAM" may be used interchangeably throughout the present specification with the terms "tether", "PMAM tether", "heavy atom tether", "photochemical mediating tether" and other like terms when the distal end of the photochemical mediating axial moiety is bonded to an R unit rather than a hydrogen atom.

Without wishing to be limited by theory, this interaction between the heavy atoms and the photosensitizing group facilitates the inter system crossing of electrons of the photosensitizing group from a photochemically excited singlet state to an excited triplet state resulting in an increased out put of singlet oxygen molecules.

An example of a photochemical mediating axial moiety D which is attached to a photochemical singlet oxygen generator has the formula:

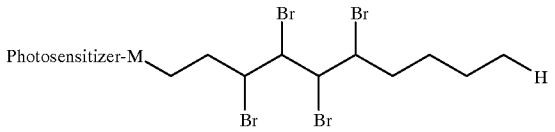

wherein the proximal end of $L^1$ is bonded to a metal or non-metal atom M chelated by a photosensitizer unit, the distal end of $L^1$ is bonded to an R unit wherein R is equal to hydrogen and the $L^1$ tether is a 3,4,5,6-tetrabromodecanylene unit. Preferred photochemical mediating axial moieties comprise an R unit which is not hydrogen.

Further non limiting examples of photochemical mediating axial moiety $L^1$ units include 3,4,5,6,7-pentachloroheptylene, 3,4,5,6,7-pentachlorooctylene, 3,4,5,6-tetrabromoheptylene, 3,4,5,6-tetrabromooctylene, 3,4,5-tribromoheptylene, 3,4,5-tribromooctylene, 3,4-diiodoheptylene, 3,4-diiodooctylene, and 4,5-diiodononylene.

Axial R Units

The photochemical singlet oxygen generators of the present invention useful for the present invention optionally comprise axial R units wherein each R is independently selected from the group consisting of:

a) hydrogen;
b) halogen;
c) hydroxyl;
d) cyano;
e) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;
f) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;
g) polyhydroxyl substituted $C_3$–$C_{22}$ alkyl;
h) $C_1$–$C_{22}$ alkoxy;
i) branched alkoxy having the formula

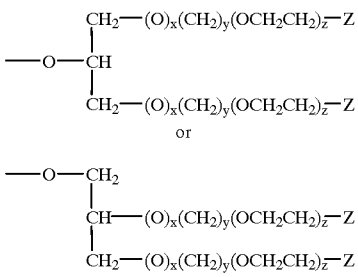

wherein Z is hydrogen, hydroxyl, $C_1$–$C_{30}$ alkyl, $C_1$–$C_{30}$ alkoxy, $—CO_2H$, $—OCH_2CO_2H$, $—SO_3^-M^+$, $—OSO_3^-M^+$, $—PO_3^{2-}M$, $—OPO_3^{2-}M$, and mixtures thereof; M is a water soluble cation in sufficient amount to satisfy charge balance; x is 0 or 1, each y independently has the value from 0 to 6, preferably from 0 to 6; each z independently has the value from 0 to 100, preferably from 0 to about 10, more preferably from 0 to about 3;

j) substituted aryl, unsubstituted aryl, or mixtures thereof;
k) substituted alkylenearyl, unsubstituted alkylenearyl or mixtures thereof;
l) substituted aryloxy, unsubstituted aryloxy, of mixtures thereof;
m) substituted oxyalkylenearyl, unsubstituted oxyalkylenearyl, or mixtures thereof;
n) substituted alkyleneoxyaryl, unsubstituted alkyleneoxyaryl, or mixtures thereof;
o) $C_1$–$C_{22}$ thioalkyl, $C_3$–$C_{22}$ substituted thioalkyl, and mixtures thereof;
p) alkyleneamino units;
q) an amino unit of the formula $$—NR^{17}R^{18}$$

wherein $R^{17}$ and $R^{18}$ comprises $C_1$–$C_{22}$ alkyl, $C_3$–$C_{22}$ branched alkyl, $C_2$–$C_{22}$ alkenyl, $C_3$–$C_{22}$ branched alkenyl, and mixtures thereof;

r) alkylethyleneoxy units having the formula:

$$—(A)_k—(CH_2)_mOCH_2CH_2)_nZ$$

wherein A is the heteroatom nitrogen or oxygen, preferably A is oxygen, the index k is 0 when the heteroatom is absent, k is equal to 1 when the heteroatom is present, Z is hydrogen, hydroxyl, $C_1$–$C_{30}$ alkoxy, aryl, substituted aryl, aryloxy, substituted aryloxy, alkyleneamino, $—SO_3^-M^+$, $—OSO_3^-M^+$, $—CO_2M$, $—CH_2CO_2M$, and mixtures thereof, preferably hydrogen or $C_1$–$C_{30}$ alkoxy; n is from 1 to 100, preferably from 0 to about 20, more preferably from 2 to about 10; and m is from 1 to 12, preferably from about 1 to about 5;

s) carboxylate of the formula

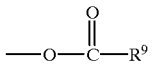

wherein $R^9$ comprises:

i) $C_1$–$C_{22}$ alkyl, $C_3$–$C_{22}$ branched alkyl, $C_2$–$C_{22}$ alkenyl, $C_3$–$C_{22}$ branched alkenyl, and mixtures thereof;
ii) halogen substituted $C_1$–$C_{22}$ alkyl, $C_3$–$C_{22}$ branched alkyl, $C_2$–$C_{22}$ alkenyl, $C_3$–$C_{22}$ branched alkenyl, and mixtures thereof;
iii) poly-hydroxyl substituted $C_3$–$C_{22}$ alkyl;
iv) $C_3$–$C_{22}$ glycol;
v) $C_1$–$C_{22}$ alkoxy;
vi) $C_3$–$C_{22}$ branched alkoxy;
vii) substituted aryl, unsubstituted aryl, or mixtures thereof;
viii) substituted alkylaryl, unsubstituted alkylaryl, or mixtures thereof;
ix) substituted aryloxy, unsubstituted aryloxy, or mixtures thereof;
x) substituted alkoxy, unsubstituted alkoxyaryl, or mixtures thereof;
xi) substituted alkyleneoxyaryl, unsubstituted alkyleneoxyaryl, of mixtures thereof;

t) siloxy and substituted siloxy of the formula $—OSiR^{19}R^{20}R^{21}$ wherein each $R^{19}$, $R^{20}$, and $R^{21}$ is independently selected from the group consisting of $C_1$–$C_{22}$ alkyl, $C_3$–$C_{22}$ branched alkyl, $C_2$–$C_{22}$ alkenyl, $C_3$–$C_8$ branched alkenyl, substituted alkyl, aryl, alkylethyleneoxy units of the formula $$—(A)_k—(CH_2)_m(OCH_2CH_2)_nZ$$

wherein Z is hydrogen, $C_1$–$C_{30}$ alkyl, hydroxyl, $—CO_2M$, $—CH_2CO_2M$, $—SO_3^-M^+$, $—OSO_3^-M^+$, $C_1$–$C_6$ alkoxy, aryl, substituted aryl, aryloxy, substituted aryloxy alkyleneamino; and mixtures thereof; A units comprise nitrogen or oxygen, M is a water soluble cation, k is 0 or 1, n is from 0 to 100, m is from 0 to 12; and mixtures thereof; and, alkyleneamino units and mixtures thereof.

According to the present invention the preferred axial R units comprise moieties having the formula $$—Y_i—K_j \text{ and } —Y_i—Q_j$$

wherein

Y is a linking moiety selected from the group consisting of O, $CR^{25}R^{26}$, $OSiR^{25}R^{26}$, $OSnR^{25}R^{26}$, and mixtures thereof; wherein $R^{25}$ and $R^{26}$ are hydrogen, $C_1$–$C_4$ alkyl, halogen, and mixtures thereof; i is 0 or 1, j is from 1 to 3;

K is a ligand selected from the group consisting of:

a) $C_1$–$C_{30}$ linear alkyl, $C_3$–$C_{30}$ branched alkyl, $C_2$–$C_{30}$ linear alkenyl, $C_3$–$C_{30}$ branched alkenyl, $C_6$–$C_{20}$ aryl, $C_7$–$C_{20}$ arylalkyl, $C_7$–$C_{20}$ alkylaryl, and mixtures thereof;

b) an alkylethyleneoxy unit of the formula $$—(R^{23})_y(OR^{22})_xOZ$$

wherein Z is selected from the group consisting of hydrogen, $C_1$–$C_{20}$ alkyl, $C_3$–$C_{20}$ branched alkyl, $C_2$–$C_{20}$ linear alkenyl, $C_3$–$C_{20}$ branched alkenyl, $C_6$–$C_{20}$ aryl, $C_7$–$C_{30}$ arylalkyl, $C_6$–$C_{20}$ alkylarl, and mixtures thereof, $R^{22}$ is selected from the group consisting of $C_1$–$C_4$ linear alkylene, $C_3$–$C_4$ branched alkylene, $C_3$–$C_6$ hydroxyalkylene, and mixtures thereof, $R^{23}$ is selected from the group consisting of $C_2$–$C_{20}$ alkylene, $C_3$–$C_{20}$ branched alkylene, $C_6$–$C_{20}$ arylene, $C_7$–$C_{30}$ arylalkylene, $C_7$–$C_{30}$ alkylarylene, and mixtures thereof; x is from 1 to 100; y is 0 or 1; and Q is an ionic moiety having the formula:

$$—R^{24}—W$$

wherein $R^{24}$ is selected from the group consisting of $C_3$–$C_{30}$ linear alkylene, $C_3$–$C_{30}$ branched alkylene, $C_2$–$C_{30}$ linear alkenylene, $C_3$–$C_{30}$ branched alkenylene, $C_6$–$C_{16}$ arylene, and mixtures thereof, W is selected from the group consisting of $—CO_2^-M^+$, $—SO_3^-M^+$, $—OSO_3^-M^+$; $PO_3^{2-}M^+$, $—OPO_3^-M^+$, $—N^+(R^{27})_3X^-$;

wherein $R^{27}$ is independently hydrogen, $C_1$–$C_6$ alkyl, $—(CH_2)_nOH$, $—(CH_2CH_2O)_nH$, and mixtures thereof, wherein n is from 1 to 4; M is a water soluble cation of sufficient charge to provide electronic neutrality and X is a water soluble anion as defined herein above.

Preferred axial R units are alkyl alkyleneoxy units of the formula $$—(R^{23})_y(OR^{22})_xOZ$$

wherein Z is selected from the group consisting of hydrogen, $C_7$–$C_{20}$ linear alkyl, $C_3$–$C_{20}$ branched alkyl, $C_2$–$C_{20}$ linear alkenyl, $C_3$–$C_{20}$ branched alkenyl, $C_6$–$C_{10}$ aryl, $C_7$–$C_{20}$ arylalkyl, $C_7$–$C_{20}$ alkylaryl, and mixtures thereof; $R^{22}$ is selected from the group consisting of $C_1$–$C_4$ linear alkylene, $C_3$–$C_4$ branched alkylene, and mixtures thereof, $R^{23}$ is selected from the group consisting of $C_2$–$C_6$ alkylene, $C_3$–$C_6$ branched alkylene, $C_6$–$C_{10}$ arylene, and mixtures thereof, x is from 1 to 50, y is 0 or 1.

More preferred axial R units comprise y equal to 0, Z is hydrogen, $C_1$–$C_{20}$ alkyl, $C_3$–$C_{20}$ branched alkyl, $C_6$–$C_{10}$ aryl, and mixtures thereof, most preferred Z is hydrogen or $C_6$–$C_{20}$ linear alkyl, $C_{10}$–$C_{20}$ branched alkyl; $R^{22}$ is $C_1$–$C_4$ linear or $C_3$–$C_4$ branched alkylene.

Also preferred R units having the formula:

$$—Y_i—Q_j$$

wherein Y is a linking moiety selected from the group consisting of O, $CR^{25}R^{26}$ $OSiR^{25}R^{26}$, $OSnR^{25}R^{26}$, and mixtures thereof; i is 0 or 1, j is from 1 to 3; Q is an ionic moiety having the formula:

$$—R^{24}—W$$

wherein $R^{24}$ is selected from the group consisting of $C_2$–$C_{20}$ linear alkylene, $C_3$–$C_{20}$ branched alkylene, $C_2$–$C_{20}$ linear alkenylene, $C_3$–$C_{20}$ branched alkenylene, $C_6$–$C_{10}$ arylene, and mixtures thereof; W is selected from the group consisting of $—CO_2^-M^+$, $—SO_3^-M^+$, $—OSO_3^-M^+$; $PO_3^{2-}M^+$, $—OPO_3^-M^+$, $—N^+(R^{27})_3X^-$; wherein $R^{27}$ is independently hydrogen, $C_1$–$C_6$ alkyl, $—(CH_2)_nOH$, $—(CH_2CH_2O)_nH$, and mixtures thereof; wherein n is from 1 to 4; M is a water soluble cation of sufficient charge to provide electronic neutrality and X is a water soluble anion as defined herein above.

A preferred hydrophilic R has the index i equal to 1; $R^{24}$ is $C_3$–$C_{20}$ linear alkylene, $C_3$–$C_{20}$ branched alkylene; W is $—CO_2^-M^+$, $—SO_3^-M^+$, $—OSO_3^-M^+$; M is a water soluble cation of sufficient charge to provide electronic neutrality.

Examples of Y units suitable for use in R units having the formula:

$$—Y_i—K_j$$

have the formula $$—O—K^1,\ —Sn—K^1,\ —OSn—K^1$$

wherein i is equal to 1 and j is equal to 1. Further examples have the formula

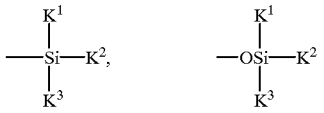

wherein i is equal to 1 and j is equal to 3. The above examples also apply to Y units when used with Q ionic moieties.

The present invention also relates to laundry detergent compositions comprising:

a) at least about 0.1%, preferably from about 0.1% to about 30%, more preferably from about 1% to about 30%, most preferably from about 5% to about 20% by weight, of a detersive surfactant, said detersive surfactant is selected from the group consisting of anionic, cationic, nonionic, zwitterionic, ampholytic surfactants, and mixtures thereof;

b) at least about 0.001 ppm, preferably from about 0.01 to about 10000 ppm, more preferably from about 0.1 to about 5000 ppm, most preferably form about 10 to about 1000 ppm, of a source of singlet oxygen having the formula:

wherein P is a photosensitizing unit; each D is independently a having the formula:

$$—L^1—R$$

wherein $L^1$ is $C_1$–$C_{20}$ linear or branched alkylene, $C_1$–$C_{20}$ linear or branched alkenylene, $C_6$–$C_{20}$ substituted or unsubstituted arylene, $C_6$–$C_{20}$ substituted or unsubstituted aryleneoxy, $C_7$–$C_{30}$ linear or branched alkylenearylene; provided $L^1$ is substituted within 10 covalent bonds of the photosensitizing unit by at least one heavy atom, said heavy atom selected from the group consisting of chlorine, bromine, iodine, and mixtures thereof, preferably bromine or iodine; and R is an axial moiety which mediates the solubility or substantivity of the singlet oxygen generator; and c) the balance carriers and adjunct ingredients, said adjunct ingredients are members selected from the group consisting of buffers, builders, chelants, filler salts, soil release agents, dispersants, enzymes, enzyme boosters, perfumes, thickeners, abrasives, solvents, clays, and mixtures thereof.

Preferably the laundry detergent compositions of the present invention comprise from about 0.1% to about 30% by weight, preferably from about 1% to about 30% by weight, more preferably from about 5% to about 20% by weight, of detersive surfactant.

It is also an object of the present invention to provide hard surface cleaning compositions which can be used to clean or disinfect hard surfaces, said compositions comprising:

a) at least 0.1% preferably from about 0.1% to about 30%, more preferably from about 1% to about 30% by weight, most preferably from about 5% to about 20% by weight, of a detersive surfactant, said detersive surfactant is selected from the group consisting of anionic, cationic, nonionic, zwitterionic, ampholytic surfactants, and mixtures thereof;

b) at least about 0.001% by weight, of a source of singlet oxygen having the formula wherein P is a photosensitizing unit; each D is independently a having the formula:

$$—L^1—R$$

wherein $L^1$ is $C_1$–$C_{20}$ linear or branched alkylene, $C_1$–$C_{20}$ linear or branched alkenylene, $C_6$–$C_{20}$ substituted or unsubstituted arylene, $C_6$–$C_{20}$ substituted or unsubstituted aryleneoxy, $C_7$–$C_{30}$ linear or branched alkylenearylene; provided $L^1$ is substituted within 10 covalent bonds of the photosensitizing unit by at least one heavy atom, said heavy atom selected from the group consisting of chlorine, bromine, iodine, and mixtures thereof, preferably bromine or iodine; and R is an axial moiety which mediates the solubility or substantivity of the singlet oxygen generator; and c) the balance carriers and adjunct ingredients, said adjunct ingredients are members selected from the group consisting of buffers, builders, chelants, filler salts, soil release agents, dispersants, enzymes, enzyme boosters, perfumes, thickeners, abrasives, solvents, clays, and mixtures thereof.

The present invention also relates to a method for cleaning a stained fabric comprising contacting a stained fabric in need of cleaning with an aqueous cleaning solution comprising at least 0.001 ppm of the single oxygen generator according to the present invention followed by exposing the surface of the treated fabric to a source of light having a minimal wavelength range from about 300 to about 1200 nanometers.

The present invention further relates to a method for cleaning a hard surface comprising contacting a hard surface in need of cleaning with an aqueous cleaning composition comprising at least 0.001 ppm of the singlet oxygen generator according to the present invention and exposing the hard surface to a source of light having a minimal wavelength range from about 300 to about 1200 nanometers.

The present invention yet further relates to a method for cleaning a stained fabric with a cleaning material comprising a low aqueous cleaning composition comprising contacting a stained fabric in need of stain removal with a low aqueous cleaning solution comprising less than 50% water and at least 0.001 ppm of the singlet oxygen generator according to the present invention followed by exposing the surface of the treated fabric to a source of light having a minimal wavelength range from about 300 to about 1200 nanometers.

The present invention still further relates to a method for cleaning a hard surface with a low aqueous cleaning composition comprising contacting a hard surface in need of cleaning with a low aqueous cleaning composition comprising less than 50% water and at least 0.001 ppm of the singlet oxygen generator according to the present invention and exposing the hard surface to a source of light having a minimal wavelength range from about 300 to about 1200 nanometers.

The laundry detergent compositions of the present invention may be liquid, granular or semi-solid, for example a gel, paste, or viscous cream.

The present invention also relates to a method for cleaning a stained fabric comprising contacting a stained fabric in need of cleaning with an aqueous cleaning solution comprising at least 0.001% of the singlet oxygen generator according to the present invention followed by exposing the surface of the treated fabric to a source of light having a minimal wavelength range from about 300 to about 1200 nanometers.

The present invention also relates to a method for cleaning a hard surface comprising contacting a hard surface in need of cleaning with an aqueous cleaning composition comprising at least 0.001% of the singlet oxygen generator according to the present invention and exposing the hard surface to a source of light having a minimal wavelength range from about 300 to about 1200 nanometers.

Surfactant—The instant singlet oxygen generator containing compositions comprise from about 0.001% to about 60% by weight of a surfactant selected from the group consisting of anionic, nonionic, ampholytic and zwitterinonic surface active agents. For liquid systems, surfactant is preferably present to the extent of from about 0.1% to 20% by weight of the composition. For solid (i.e. granular) and viscous semi-solid (i.e. gelatinous, pastes, etc.) systems, surfactant is preferably present to the extent of from about 1.5% to 30% by weight of the composition.

Nonlimiting examples of surfactants useful herein typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)\ CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10\text{-}18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are described further herein and are listed in standard texts.

Anionic surfactants can be broadly described as the water-soluble salts, particularly the alkali metal salts, of organic sulfuric reaction products having in their molecular structure an alkyl radical containing from about 8 to about 22 carbon atoms and a radical selected from the group consisting of sulfonic acid and sulfuric acid ester radicals. (Included in the term alkyl is the alkyl portion of higher acyl radicals.) Important examples of the anionic synthetic detergents which can form the surfactant component of the compositions of the present invention are the sodium or potassium alkyl sulfates, especially those obtained by sulfating the higher alcohols (C8–18 carbon atoms) produced by reducing the glycerides of tallow or coconut oil; sodium or potassium alkyl benzene sulfonates, in which the alkyl group contains from about 9 to about 15 carbon atoms, (the alkyl radical can be a straight or branched aliphatic chain); sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid ester of the reaction product of one mole of a higher fatty alcohol (e.g. tallow or coconut alcohols) and about 1 to about 10 moles of ethylene oxide; sodium or potassium salts of alkyl phenol ethylene oxide ether sulfates with about 1 to about 10 units of ethylene oxide per molecule and in which the alkyl radicals contain from 8 to 12 carbon atoms; the reaction products of fatty acids are derived from coconut oil sodium or potassium salts of tatty acid amides of a methyl tauride in which the fatty acids, for example, are derived from coconut oil and sodium or potassium beta-acetoxy- or beta-acetamido-alkanesulfonates where the alkane has from 8 to 22 carbon atoms.

Additionally, secondary alkyl sulfates may be used by the formulator exclusively or in conjunction with other surfactant materials and the following identifies and illustrates the differences between sulfated surfactants and otherwise conventional alkyl sulfate surfactants. Non-limiting examples of such ingredients are as follows.

Conventional primary alkyl sulfates. such as those illustrated above, have the general formula ROSO3-M+ wherein R is typically a linear C8–22 hydrocarbyl group and M is a water solublizing cation. Branched chain primary alkyl sulfate surfactants (i.e., branched-chain "PAS") having 8–20 carbon atoms are also know; see, for example, Eur. Pat. Appl. 439,316, Smith et al., filed Jan. 21, 1991.

Conventional secondary alkyl sulfate surfactants are those materials which have the sulfate moiety distributed randomly along the hydrocarbyl "backbone" of the molecule. Such materials may be depicted by the structure $$CH_3(CH_2)_n(CHOSO_3^-M^+)(CH_2)_mCH_3$$

wherein m and n are integers of 2 of greater and the sum of m+n is typically about 9 to 17, and M is a water-solublizing cation.

The aforementioned secondary alkyl sulfates are those prepared by the addition of $H_2SO_4$ to olefins. A typical synthesis using alpha olefins and sulfuric acid is disclosed in U.S. Pat. No. 3,234,258, Morris, issued Feb. 8, 1966 or in U.S. Pat. No. 5,075,041, Lutz, issued Dec. 24, 1991. The synthesis conducted in solvents which afford the secondary (2,3) alkyl sulfates on cooling, yields products which, when purified to remove the unreacted materials, randomly sulfated materials, unsulfated by-products such as C10 and higher alcohols, secondary olefin sulfonates, and the like, are typically 90+% pure mixtures of 2- and 3-sulfated materials (some sodium sulfate may be present) and are white, non tacky, apparently crystalline, solids. Some 2,3-disulfates may also be present, but generally comprise no more than 5% of the mixture of secondary (2,3) alkyl mono-sulfates. Such materials are available as under the name "DAN", e.g., "DAN 200" from Shell Oil Company.

Adjunct Materials

The following are non-limiting examples of adjunct ingredients suitable for use in either laundry or hard surface cleaning or disinfecting compositions according to the present invention.

Chelating Agents—The photo disinfectant compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that certain chelating agents will interact with photodisinfectants of the present invention to increase their absorbency in the visible light spectrum. This is a process that is due to the ability of chelating agents to help effect the "substantiveness" of the compounds of the present invention.

Amino carboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilized, these chelating agents will generally comprise from about 0.1% to about 10% by weight of the detergent compositions herein. More preferably, if utilized, the chelating agents will comprise from about 0.1% to about 3.0% by weight of such compositions Inert Salts. The inert salts (filler salts) used in the compositions of the present invention can be any water-soluble inorganic or organic salt or mixtures of such salts which do not destabilize any surfactant present. For the purposed of the present invention, "water-soluble" means having a solubility in water of at least 1 gram per 100 grams of water at 20° C. Examples of suitable salts include various alkali metal and/or alkali earth metal sulfate, chlorides, borates, bromides, fluorides, phosphates, carbonates, bicarbonates, citrates, acetates, lactates, etc.

Specific examples of suitable salts include sodium sulfate, sodium chloride, potassium chloride, sodium carbonate, potassium sulfate, lithium chloride, lithium sulfate, tripotassium phosphate, sodium borate, potassium bromide, potassium fluoride, sodium bicarbonate, magnesium sulfate, magnesium chloride, sodium citrate, sodium acetate, magnesium lactate, sodium fluoride. The preferred salts are inorganic salts preferably the alkali metal sulfates and chlorides. Particularly preferred salts, because of their low cost are sodium sulfate and sodium chloride. The salts are present in the compositions at levels of from 0% to 40%, preferably 10% to 20%.

EXAMPLE 1

Preparation of Silicon Phthalocyanine Dichloride

To a mixture of 1,3-diiminoisoindoline (0.333 gm, 2.3 mmole) and anhydrous quinoline (15 mL) under argon blanketing is added silicon tetrachloride (1.1 g, 6.5 mmole). The mixture is lowered into an oil bath at 60° C. for 0.5 hr, heated to reflux over 0.5 hr, stirred at reflux for an additional 0.5 hr and cooled over 1 hr. To this solution is added methanol (10 mL) and the resultant mixture is allowed to stand at room temperature for 24 hr. The blue solid which forms upon standing is filtered off, rinsed twice with 10 mL portions of methanol, dried under vacuum at 120° C. and used without further purification.

The above procedure is suitable for use in preparing silicon naphthalocyanine dichloride using 1,3-diiminobenz-[f]-isoindoline.

EXAMPLE 2

Preparation of 1:3 Silicon(VI)Phthalo/naphthalocyanine Dichloride

To a mixture of 1,3-diiminoisoindoline (0.333 gm, 2.3 mmole), 1,3-diiminobenz[f]-isoindoline (1.35 gm, 6.9 mmole) and anhydrous quinoline (15 mL) under argon blanketing is added silicon tetrachloride (2.21 g, 12.9 mmole). The mixture is lowered into an oil bath at 60° C. for 0.5 hr, heated to reflux over 0.5 hr, stirred at reflux 0.5 hr and cooled over 1 hr. To this solution is added methanol (10 mL) and the resultant mixture is allowed stand at room temperature for 24 hr. The green solid which forms is removed by filtration, rinsed twice with 10 mL portions of methanol, dried under vacuum at 120° C. and used without further purification.

EXAMPLE 3

Preparation of Silicon Phthalocyanine Dihydroxide

Silicon (IV) phthalocyanine dichloride (2 gm, 3.3 mmole) is added to a refluxing solution of sodium methoxide (0.8 g, 14.8 mmole) in 95% wet ethanol (15 mL). The reaction mixture is refluxed 4 hr then cooled to room temperature. The resulting product is collected by filtration, rinsed with water and used without subsequent purification.

The above procedure is suitable for use in preparing silicon naphthalocyanine dihydroxide, and 1:3 silicon (IV) phthalo/naphthalocyanine dihydroxide.

EXAMPLE 4

Preparation of Dilithium Naphthalocyanine

To a refluxing solution of 2,3-dicyanonaphthalene (10 gm, 56.1 mmole) in anhydrous 1-butanol (300 mL) is added lithium shot (1.56 gm, 224.5 mmole). The solution is refluxed 6 hr under a blanket of argon after which time the solution is cooled, diluted with absolute methanol (500 mL) and allowed to stand at 0° C. for 18 hr. The green solid which results is collected by filtration, dried under vacuum at 80° C. and used without subsequent purification.

The above procedure is suitable for use in preparing 1,4,8,11,15,18,22,25-octabutoxy-29,31-dilithium phthalocyanine from 3,6-dibutoxyphthalonitrile; 2,3,9,10,16,17,23,24-octachloro-29-31-dilithium phthalocyanine from 4,5-dichlorophthalonitrile; and tetrabutoxy-29,31-dilithium phthalocyanine from 3-butoxyphthalonitrile wherein there is a mixture of isomers.

EXAMPLE 5

Preparation of Naphthalocyanine

To a solution of dilithium naphthalocyanine (2 gm, 2.75 mmole) in N,N-Dimethylformamide (200 mL) is added 1N hydrochloric acid (10 mL). The solution is stirred at room temperature for 1 hr. To this solution is added distilled water (200 mL) over approximately 0.5 hr. The green solid which forms is collected by filtration, dried under vacuum at 100° C. and used without further purification.

The above procedure is suitable for use in preparing 1,4,8,11,15,18,22,25-octabutoxy-29H,31H-phthalocyanine; 2,3,9,10,16,17,23,24-octachloro-29H,31H-phthalocyanine; and tetrabutoxy-29H,31H-phthalocyanine.

EXAMPLE 6

Preparation of silicon phthalocyanine-di-(1,3-dibromopropan-2-ol)

Silicon phthalocyanine dihydroxide (0.25 gm, 0.44 mmole), anhydrous 1,3-dibromopropan-2-ol (10 gm, 68.8 mmole) and xylenes (175 mL) are combined and heated to reflux over 1.5 hrs. The solution is continued at reflux for 2 hr. while water is removed by azeotropic distillation. The reaction solution is cooled and the solvent and excess 1,3-dibromopropan-2-ol are removed in vacuo. The resulting solid is used without further purification.

The above procedure is suitable for use in preparing silicon(VI) phthalo/naphthalo-cyanine-di-(1,3-dibrompropan-2-ol).

EXAMPLE 7

Preparation of silicon naphthalocyanine-di-(3,5-dibromo-4-hydroxybenzoic acid)

Silicon naphthalocyanine dioctyloxide (0.25 g, 0.27 mmole), anhydrous 3,5-dibromo-4-hydroxybenzoic acid (10 g, 33.8 mmole) and xylenes (175 ml) are combined and heated to reflux over 1.5 hr. The solution is continued at reflux for 24 hr. while water is removed by azeotropic distillation. The reaction solution is cooled and washed with aqueous sodium carbonate (0.1M) and the solvent removed in vacuo. The resulting green solid is used without further purification.

The above procedure is suitable for use in preparing silicon (VI) phthalo/naphthalocyanine-di-(3,5-dibromo-4-hydroxybenzoic acid). The cleaning compositions provided in accordance with this invention may be in the form of granules, liquids, bars, and the like, and typically are formulated to provide an in-use pH in the range of 9 to 11, however in the case of non-aqueous or low aqueous compositions the pH ranges may vary outside this range. Various carriers such as sodium sulfate, water, water-ethanol, BPP, MPP, EPP, PPP, sodium carbonate, and the like, may be used routinely to formulate the finished products. Granules may be produced by spray-drying or by agglomeration, using known techniques, to provide products in the density range of 350–950 g/l. Bars may be formulated using conventional extrusion techniques. The compositions may also contain conventional perfumes, bactericides, hydrotropes and the like. In the case of non-aqueous or low aqueous compositions, the cleaning compositions may be applied to an article which is used to deliver the compositions of the present invention to a fabric or to a hard surface. Non-limiting examples of compositions according to this invention are as follows:

| Ingredients | weight % | | | |
|---|---|---|---|---|
| | 8 | 9 | 10 | 11 |
| Sodium LAS | 15 | 30 | 20 | 25 |
| NEODOL | 1 | 1 | 1 | 1 |
| Alkyl Dimethyl Ammonium Chloride | 0.5 | 1 | 0.5 | 0.7 |
| Sodium Tripolyphosphate | 15 | 35 | 22 | 28 |
| Sodium Carbonate | 10 | 10 | 15 | 15 |
| SOKALAN | 2 | 2 | 2 | 2 |
| Carboxymethyl Cellulose | 1 | 1 | 1 | 1 |
| Tinopal CBS-X | 0.1 | 0.1 | 0.1 | 0.1 |
| Soil Release Agent[1] | 0.2 | 0.2 | 0.3 | 0.3 |
| Savinase 6.0T | 0.3 | 0.6 | 0.5 | 0.6 |
| BAN 300T | 0.2 | 0.5 | 0.5 | 0.6 |
| Lipolase 100T | 0.1 | 0.2 | 0.2 | 0.3 |
| CAREZYME 5T | 0.1 | 0.2 | 0.2 | 0.3 |
| Sodium Perborate | — | — | 3.0 | 5.0 |
| NOBS | — | — | 2.0 | 3.0 |
| Photobleach[2] (ppm) | 0.005 | 0.01 | — | — |
| Photobleach[3] (ppm) | — | — | 0.008 | 0.01 |
| Moisture + Sodium Sulfate + Perfume + Miscellaneous | Balance | Balance | Balance | Balance |

[1]Soil Release Agent according to U.S. Pat. No. 5,415,807 Gosselink et al., issued May 16, 1995.
[2]Photobleach according to Example 6.
[3]Photobleach according to Example 7.

What is claimed is:

1. A photochemical singlet oxygen generator having the formula:

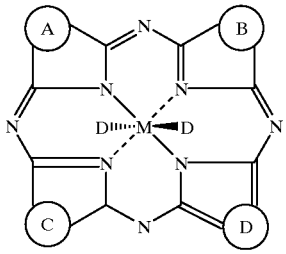

or the formula:

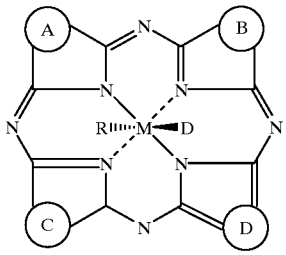

wherein M is a photoactive metal or non-metal, selected from the group consisting of silicon, aluminum, phosphorous, platinum, palladium, tin, lead, germanium, and mixtures thereof; rings A, B, C, and D are each independently:

i) a benzene ring unit having the formula:

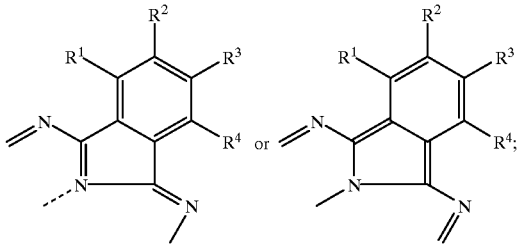

ii) a 2,3-naphthylene ring unit having the formula:

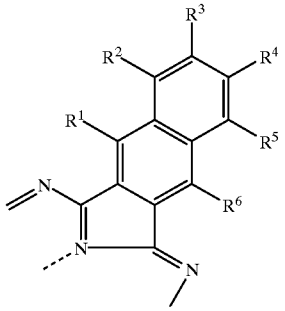

or

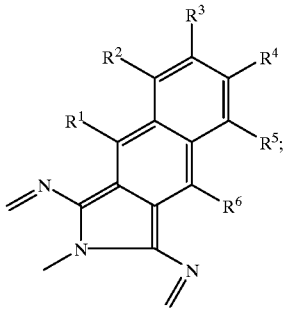

iii) a 1,2-naphthylene ring unit having the formula:

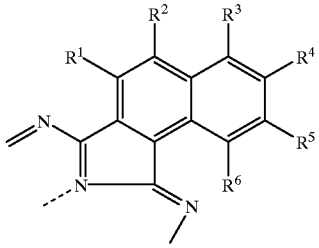

or

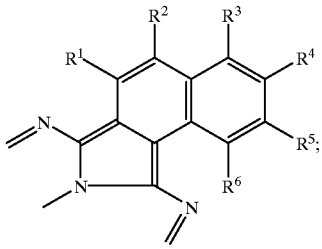

iv) an anthracene ring unit having the formula:

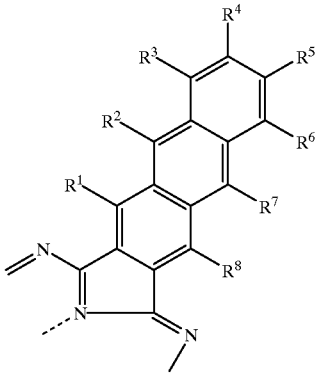

or

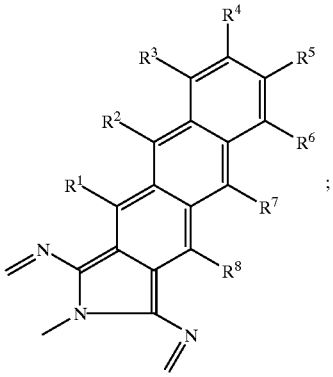

; and v) an phenanthrene ring unit having the formula:

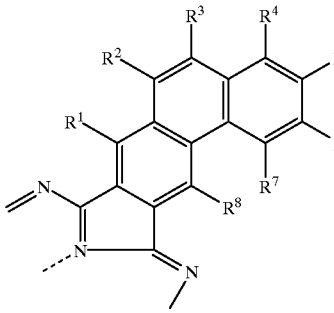

or

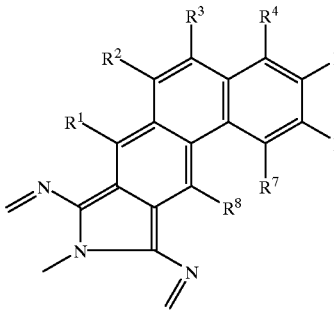

wherein each $R^1$, $R^2$, $R^3$, $R^4$, $R^5$, $R^6$, $R^7$, and $R^8$ unit is independently selected from the group consisting of:

a) hydrogen;

b) halogen;

c) hydroxy;

d) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

e) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

f) polyhydroxyl substituted $C_3$–$C_{22}$ alkyl;

g) $C_1$–$C_{22}$ alkoxy;

h) branched alkoxy having the formula:

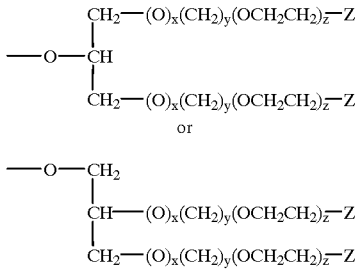

wherein Z is hydrogen, hydroxyl, $C_1$–$C_{30}$ alkyl, $C_1$–$C_{30}$ alkoxy, $—CO_2H$, $—OCH_2CO_2H$, $—SO_3^-M^+$, $—OSO_3^-M^+$, $—PO_3^{2-}M$, $—OPO_3^{2-}M$, or mixtures thereof; M is a water soluble cation in sufficient amount to satisfy charge balance; x is 0 or 1, each y independently has the value from 0 to 6, each z independently has the value from 0 to 100;

i) substituted aryl, unsubstituted aryl, or mixtures thereof;

j) substituted alkylenearyl, unsubstituted alkylenearyl, or mixtures thereof;

k) substituted aryloxy, unsubstituted aryloxy, or mixtures thereof;

l) substituted oxyalkylenearyl, unsubstituted oxyalkylenearyl, or mixtures thereof;

m) substituted alkyleneoxyaryl, unsubstituted alkyleneoxyaryl, or mixtures thereof;

n) $C_1$–$C_{22}$ thioalkyl, $C_3$–$C_{22}$ branched thioalkyl, or mixtures thereof;

o) an ester of the formula $—CO_2R^9$ wherein $R^9$ is i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

iii) polyhydroxyl substituted $C_3$–$C_{22}$ alkylene;

iv) $C_3$–$C_{22}$ glycol;

v) $C_1$–$C_{22}$ alkoxy;

vi) $C_3$–$C_{22}$ branched alkoxy;

vii) substituted aryl, unsubstituted aryl, or mixtures thereof;

viii) substituted alkylenearyl, unsubstituted alkylenearyl, or mixtures thereof;

ix) substituted aryloxy, unsubstituted aryloxy, or mixtures thereof;

x) substituted oxyalkylenearyl, unsubstituted oxyalkylenearyl, or mixtures thereof;

xi) substituted alkyleneoxyaryl, unsubstituted alkyleneoxyaryl, or mixtures thereof;

p) an alkyleneamino unit of the formula:

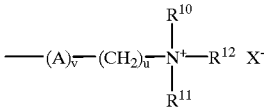

wherein $R^{10}$ and $R^{11}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

$R^{12}$ is:

i) hydrogen;

ii) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

A is nitrogen or oxygen; X is chlorine, bromine, iodine, or other water soluble anion, v is 0 or 1, u is from 0 to 22;

q) an amino unit of the formula:

$$—NR^{17}R^{18}$$

wherein $R^{17}$ and $R^{18}$ are $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

r) an alkylethyleneoxy unit of the formula:

$$—(A)_v—(CH_2)_y(OCH_2CH_2)_xZ$$

wherein Z is:

i) hydrogen;

ii) hydroxyl;

iii) $—CO_2H$;

iv) $—SO_3^-M^+$;

v) $—OSO_3^-M^+$;

vi) $C_1$–$C_6$ alkoxy;

vii) substituted aryl, unsubstituted aryl, or mixtures thereof;

viii) substituted aryloxy, unsubstituted aryloxy, or mixtures thereof;

ix) alkyleneamino; or mixtures thereof;

A is nitrogen or oxygen, M is a water soluble cation, v is 0 or 1, x is from 0 to 100, y is from to 12;

s) substituted siloxy of the formula:

$$—OSiR^{19}R^{20}R^{21}$$

wherein each $R^{19}$, $R^{20}$, and $R^{21}$ is independently i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) substituted aryl, unsubstituted aryl, or mixtures thereof;

iii) substituted aryloxy, unsubstituted aryloxy, or mixtures thereof;

iv) an alkylethyleneoxy unit of the formula:

$$—(A)_v—(CH_2)_y(OCH_2CH_2)_xZ;$$

wherein Z is:

a) hydrogen;

b) hydroxyl;

c) $—CO_2H$;

d) $—SO_3^-M^+$;

e) $—OSO_3^-M^+$;

f) $C_1$–$C_6$ alkoxy;

g) substituted aryl, unsubstituted aryl, or mixtures thereof;

h) substituted aryloxy, unsubstituted aryloxy, or mixtures thereof;

i) alkyleneamino; or mixtures thereof;

A is nitrogen or oxygen, M is a water soluble cation, v is 0 or 1, xis from 0 to 100, y is from 0 to 12;

and mixtures thereof;

each D is independently a unit having the formula:

$$—L^1—R$$

wherein $L^1$ is $C_1$–$C_{20}$ linear or branched alkylene, $C_1$–$C_{20}$ linear or branched alkenylene, $C_6$–$C_{20}$ substituted or unsubstituted arylene, $C_6$–$C_{20}$ substituted or unsubstituted aryleneoxy, $C_7$–$C_{30}$ linear or branched alkylene-arylene; provided $L^1$ is substituted within 10 covalent bonds of the photosensitizing unit by at least one heavy atom, said heavy atom selected from the group consisting of chlorine, bromine, iodine, and mixtures thereof; and the R units are axial units and wherein each R unit is independently selected from the group consisting of:

a) hydrogen;

b) halogen;

c) hydroxyl;

d) cyano;

e) $C_1$–$C_{22}$ alkyl, $C_4$–$C_{22}$ branched alkyl, $C_2$–$C_{22}$ alkenyl, $C_4$–$C_{22}$ branched alkenyl, or mixtures thereof;

f) halogen substituted $C_1$–$C_{22}$ alkyl, $C_4$–$C_{22}$ branched alkyl, $C_2$–$C_{22}$ alkenyl, $C_4$–$C_{22}$ branched alkenyl, or mixtures thereof;

g) polyhydroxyl substituted $C_3$–$C_{22}$ alkyl;

h) $C_1$–$C_{22}$ alkoxy;

i) branched alkoxy having the formula:

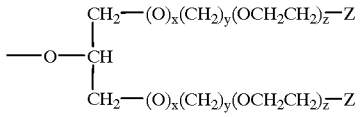

or

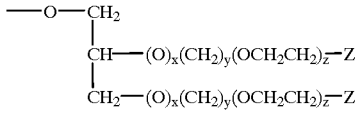

wherein Z is hydrogen, hydroxyl, $C_1$–$C_{30}$ alkyl, $C_1$–$C_{30}$ alkoxy, $—CO_2H$, $—CH_2CO_2H$, $—SO_3^-M^+$, $—OSO^{3-}M^+$, $—PO_3^{2-}M$, $—OPO_3^{2-}M$, and mixtures thereof; M is a water soluble cation in sufficient amount to satisfy charge balance; x is 0 or 1, each y independently has the value from 0 to 6, each z independently has the value from 0 to 100;

j) substituted aryl, unsubstituted aryl, or mixtures thereof;

k) substituted alkylenearyl, unsubstituted alkylenearyl or mixtures thereof;

l) substituted aryloxy, unsubstituted aryloxy, of mixtures thereof;

m) substituted oxyalkylenearyl, unsubstituted oxyalkylenearyl, or mixtures thereof;

n) substituted alkyleneoxyaryl, unsubstituted alkyleneoxyaryl, or mixtures thereof;

o) $C_1$–$C_{22}$ thioalkyl, $C_4$–$C_{22}$ branched thioalkyl, or mixtures thereof;

p) an alkyleneamino unit of the formula:

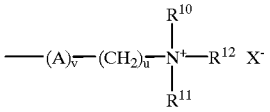

wherein $R^{10}$ and $R^{11}$ comprises $C_1$–$C_{22}$ alkyl, $C_4$–$C_{22}$ branched alkyl, $C_2$–$C_{22}$ alkenyl, $C_4$–$C_{22}$ branched alkenyl, or mixtures thereof;

$R^{12}$ comprises:

i) hydrogen;

ii) $C_1$–$C_{22}$ alkyl, $C_4$–$C_{22}$ branched alkyl, $C_2$–$C_{22}$ alkenyl, $C_4$–$C_{22}$ branched alkenyl, or mixtures thereof;

A units comprise nitrogen or oxygen; X comprises chlorine, bromine, iodine, or other water soluble anion, v is 0 or 1, u is from 0 to 22;

q) an amino unit of the formula:

$$—NR^{17}R^{18}$$

wherein $R^{17}$ and $R^{18}$ comprises $C_1$–$C_{22}$ alkyl, $C_4$–$C_{22}$ branched alkyl, $C_2$–$C_{22}$ alkenyl, $C_4$–$C_{22}$ branched alkenyl, or mixtures thereof;

r) an alkylethyleneoxy unit of the formula:

$$—(A)_v—(CH_2)_y(OCH_2CH_2)_xZ$$

wherein Z comprises:

i) hydrogen;

ii) hydroxyl;

iii) $—CO_2H$;

iv) $—CH_2CO_2H$ v) $—SO_3^-M^+$;

vi) $—OSO_3^-M^+$;

vii) $C_1$–$C_6$ alkoxy;

viii) substituted aryl, unsubstituted aryl, or mixtures thereof;

ix) substituted aryloxy, unsubstituted aryloxy, or mixtures thereof;

x) alkyleneamino; and mixtures thereof;

A comprises nitrogen or oxygen, M is a water soluble cation, v is 0 or 1, x is from 0 to 100, y is from 0 to 12;

s) carboxylate of the formula:

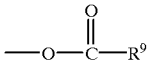

wherein $R^9$ comprises:

i) $C_1$–$C_{22}$ alkyl, $C_4$–$C_{22}$ branched alkyl, $C_2$–$C_{22}$ alkenyl, $C_4$–$C_{22}$ branched alkenyl, or mixtures thereof;

ii) halogen substituted $C_1$–$C_{22}$ alkyl, $C_4$–$C_{22}$ branched alkyl, $C_2$–$C_{22}$ alkenyl, $C_4$–$C_{22}$ branched alkenyl, or mixtures thereof;

iii) poly-hydroxyl substituted $C_3$–$C_{22}$ alkyl;

iv) $C_3$–$C_{22}$ glycol;

v) $C_1$–$C_{22}$ alkoxy;

vi) $C_4$–$C_{22}$ branched alkoxy;

vii) substituted aryl, unsubstituted aryl, or mixtures thereof;

viii) substituted alkylaryl, unsubstituted alkylaryl, or mixtures thereof;

ix) substituted aryloxy, unsubstituted aryloxy, or mixtures thereof;

x) substituted alkoxyaryl, unsubstituted alkoxyaryl, or mixtures thereof;

xi) substituted alkyleneoxyaryl, unsubstituted alkyleneoxyaryl, or mixtures thereof;

xii) alkyleneamino; or mixtures thereof;

t) substituted siloxy of the formula:

$$—OSiR^{19}R^{20}R^{21}$$

wherein each $R^{19}$, $R^{20}$, and $R^{21}$ is independently selected from the group consisting of:

i) $C_1$–$C_{22}$ alkyl, $C_4$–$C_{22}$ branched alkyl, $C_2$–$C_{22}$ alkenyl, $C_4$–$C_{22}$ branched alkenyl, or mixtures thereof;

ii) substituted aryl, unsubstituted aryl, or mixtures thereof;

iii) substituted aryloxy, unsubstituted aryloxy, or mixtures thereof;

iv) an alkylethyleneoxy unit of the formula:

$$—(A)_v—(CH_2)_y(OCH_2CH_2)_xZ;$$

wherein Z comprises:

a) hydrogen;

b) $C_1$–$C_{30}$ alkyl, c) hydroxyl;

d) $—CO_2H$;

e) $—SO_3^-M^+$;

f) $—OSO_3^-M^+$;

g) $C_1$–$C_6$ alkoxy;

h) substituted aryl, unsubstituted aryl, or mixtures thereof;

i) substituted aryloxy, unsubstituted aryloxy, or mixtures thereof;

j) alkyleneamino; or mixtures thereof;

A units comprise nitrogen or oxygen, M is a water soluble cation, v is 0 or 1, x is from 0 to 100, y is from 0 to 12;

and mixtures thereof.

2. A compound according to claim 1 wherein the axial R units have the formula:

$$—Y_i—K_j \text{ or } —Y_i—Q_j$$

wherein

Y is a linking moiety selected from the group consisting of O, $CR^{25}R^{26}$, $OSiR^{25}R^{26}$, $OSnR^{25}R^{26}$, and mixtures thereof; wherein $R^{25}$ and $R^{26}$ are hydrogen, $C_1$–$C_4$ alkyl, halogen, and mixtures thereof; i is 0 or 1, j is from 1 to 3;

K is a ligand selected from the group consisting of:

a) $C_1$–$C_{30}$ linear alkyl, $C_3$–$C_{30}$ branched alkyl, $C_2$–$C_{30}$ linear alkenyl, $C_3$–$C_{30}$ branched alkenyl, $C_6$–$C_{20}$ aryl, $C_7$–$C_{20}$ arylalkyl, $C_7$–$C_{20}$ alkylaryl;

b) an alkylethyleneoxy unit of the formula $$—(R^{23})_y(OR^{22})_xOZ$$

wherein Z is hydrogen, $C_1$–$C_{20}$ alkyl, $C_3$–$C_{20}$ branched alkyl, $C_2$–$C_{20}$ linear alkenyl, $C_3$–$C_{20}$ branched alkenyl, $C_6$–$C_{20}$ aryl, $C_7$–$C_{30}$ arylalkyl, $C_6$–$C_{20}$ alkylaryl; $R^{22}$ is $C_1$–$C_4$ linear alkylene, $C_1$–$C_4$ branched alkylene, $C_3$–$C_6$ hydroxyalkylene, and mixtures thereof; $R^{23}$ is selected from the group consisting of $C_2$–$C_{20}$ alkylene, $C_6$–$C_{20}$ branched alkylene, $C_7$–$C_{20}$ arylene, $C_7$–$C_{30}$ arylalkylene, $C_7$–$C_{30}$ alkylarylene; x is from 1 to 100; y is 0 or 1; and c) mixtures thereof;

Q is an ionic moiety having the formula:

$$—R^{24}—W$$

wherein $R^{24}$ is selected from the group consisting of $C_3$–$C_{30}$ linear alkylene, $C_3$–$C_{30}$ branched alkylene, $C_2$–$C_{30}$ linear alkenylene, $C_3$–$C_{30}$ branched alkenylene, $C_6$–$C_{16}$ arylene, and mixtures thereof; W is selected from the group consisting of $—CO_2^-M^+$, $—SO_3^-M^+$, $—OSO_3^-M^+$; $PO_3^{2-}M^+$, $—OPO_3^-M^+$, $—N^+(R^{27})_3X^-$; $R^{27}$ is independently hydrogen, $C_1$–$C_6$ alkyl, $—(CH_2)_nOH$, $—(CH_2CH_2O)_nH$, and mixtures thereof; wherein n is from 1 to 4; M is a water soluble cation of sufficient charge to provide electronic neutrality and X is a water soluble anion.

3. A compound according to claim 1 wherein the heavy atom is selected from bromine, iodine, and mixtures thereof.

4. A laundry detergent composition comprising:

a) from about 0.1 of a detersive surfactant, said detersive surfactant is selected from the group consisting of anionic, cationic, nonionic, zwitterionic, ampholytic surfactants, and mixtures thereof;

b) at least about 0.001 ppm, of a photochemical singlet oxygen generator as set forth in claim 1; and c) the balance carriers and adjunct ingredients, said adjunct ingredients are members selected from the group consisting of buffers, builders, chelants, filler salts, soil release agents, dispersants, enzymes, enzyme boosters, perfumes, thickeners, abrasives, solvents, clays, and mixtures thereof.

5. A composition according to claim 4 wherein the axial R units of the photochemical oxygen generator have the formula:

$$—Y_i—K_j \text{ or } —Y_i—Q_j$$

wherein

Y is a linking moiety selected from the group consisting of O, $CR^{25}R^{26}$, $OSiR^{25}R^{26}$, $OSnR^{25}R^{26}$, and mixtures thereof; wherein $R^{25}$ and $R^{26}$ are hydrogen, $C_1$–$C_4$ alkyl, halogen, and mixtures thereof; i is 0 or 1, j is from 1 to 3;

K is a ligand selected from the group consisting of:

a) $C_1$–$C_{30}$ linear alkyl, $C_3$–$C_{30}$ branched alkyl, $C_2$–$C_{30}$ linear alkenyl, $C_3$–$C_{30}$ branched alkenyl, $C_6$–$C_{20}$ aryl, $C_7$–$C_{20}$ arylalkyl, $C_7$–$C_{20}$ alkylaryl;

b) an alkylethyleneoxy unit of the formula $$—(R^{23})_y(OR^{22})_xOZ$$

wherein Z is hydrogen, $C_1$–$C_{20}$ alkyl, $C_3$–$C_{20}$ branched alkyl, $C_2$–$C_{20}$ linear alkenyl, $C_3$–$C_{20}$ branched alkenyl, $C_6$–$C_{20}$ aryl, $C_7$–$C_{30}$ arylalkyl, $C_6$–$C_{20}$ alkylaryl; $R^{22}$ is $C_1$–$C_4$ linear alkylene, $C_1$–$C_4$ branched alkylene, $C_3$–$C_6$ hydroxyalkylene, and mixtures thereof; $R^{23}$ is selected from the group consisting of $C_2$–$C_{20}$ alkylene, $C_6$–$C_{20}$ branched alkylene, $C_7$–$C_{20}$ arylene, $C_7$–$C_{30}$ arylalkylene, $C_7$–$C_{30}$ alkylarylene; x is from 1 to 100; y is 0 or 1; and c) mixtures thereof;

Q is an ionic moiety having the formula:

$$—R^{24}—W$$

wherein $R^{24}$ is selected from the group consisting of $C_3$–$C_{30}$ linear alkylene, $C_3$–$C_{30}$ branched alkylene, $C_2$–$C_{30}$ linear alkenylene, $C_3$–$C_{30}$ branched alkenylene, $C_6$–$C_{16}$ arylene, and mixtures thereof; W is selected from the group consisting of $—CO_2^-M^+$, $—SO_3^-M^+$, $—OSO_3^-M^+$; $PO_3^{2-}M^+$, $—OPO_3^-M^+$, $—N^+(R^{27})_3X^-$; $R^{27}$ is independently hydrogen, $C_1$–$C_6$ alkyl, $—(CH_2)_nOH$, $—(CH_2CH_2O)_nH$, and mixtures thereof; wherein n is from 1 to 4; M is a water soluble cation of sufficient charge to provide electronic neutrality and X is a water soluble anion.

6. A composition according to claim 4 comprising from about 0.1% to about 30% by weight of said detersive surfactant.

7. A composition according to claim 6 comprising from about 1% to about 30% by weight of said detersive surfactant.

8. A composition according to claim 7 comprising from about 5% to about 20% by weight of said detersive surfactant.

9. A composition according to claim 4 comprising from about 0.01 to about 10,000 ppm of the photochemical singlet oxygen generator.

10. A composition according to claim 9 comprising from about 0.1 to about 5,000 ppm of the photochemical singlet oxygen generator.

11. A composition according to claim 10 comprising from about 10 to about 1,000 ppm of the photochemical singlet oxygen generator.

12. A hard surface cleaning composition comprising:

a) from about 0.1 of a detersive surfactant, said detersive surfactant is selected from the group consisting of anionic, cationic, nonionic, zwitterionic, ampholytic surfactants, and mixtures thereof;

b) from about 0.001 ppm of a photochemical singlet oxygen generator as set forth in claim 1; and c) the balance carriers and adjunct ingredients, said adjunct ingredients are members selected from the group consisting of buffers, builders, chelants, filler salts, soil release agents, dispersants, enzymes, enzyme boosters, perfumes, thickeners, abrasives, solvents, clays, and mixtures thereof.

13. A composition according to claim 12 wherein the axial R units of the photochemical singlet oxygen generator have the formula:

$$—Y_i—K_j \text{ or } —Y_i—Q_j$$

wherein

Y is a linking moiety selected from the group consisting of O, $CR^{25}R^{26}$, $OSiR^{25}R^{26}$, $OSnR^{25}R^{26}$, and mixtures thereof; wherein $R^{25}$ and $R^{26}$ are hydrogen, $C_1$–$C_4$ alkyl, halogen, and mixtures thereof; i is 0 or 1, j is from 1 to 3;

K is a ligand selected from the group consisting of:

a) $C_1$–$C_{30}$ linear alkyl, $C_3$–$C_{30}$ branched alkyl, $C_2$–$C_{30}$ linear alkenyl, $C_3$–$C_{30}$ branched alkenyl, $C_6$–$C_{20}$ aryl, $C_7$–$C_{20}$ arylalkyl, $C_7$–$C_{20}$ alkylaryl;

b) an alkylethyleneoxy unit of the formula $$—(R^{23})_y(OR^{22})_xOZ$$

wherein Z is hydrogen, $C_1$–$C_{20}$ alkyl, $C_3$–$C_{20}$ branched alkyl, $C_2$–$C_{20}$ linear alkenyl, $C_3$–$C_{20}$ branched alkenyl, $C_6$–$C_{20}$ aryl, $C_7$–$C_{30}$ arylalkyl, $C_6$–$C_{20}$ alkylaryl; $R^{22}$ is $C_1$–$C_4$ linear alkylene, $C_1$–$C_4$ branched alkylene, $C_3$–$C_6$ hydroxyalkylene, and mixtures thereof; $R^{23}$ is selected from the group consisting of $C_2$–$C_{20}$ alkylene, $C_6$–$C_{20}$ branched alkylene, $C_7$–$C_{20}$ arylene, $C_7$–$C_{30}$ arylalkylene, $C_7$–$C_{30}$ alkylarylene; x is from 1 to 100; y is 0 or 1; and c) mixtures thereof;

Q is an ionic moiety having the formula:

$$—R^{24}—W$$

wherein $R^{24}$ is selected from the group consisting of $C_3$–$C_{30}$ linear alkylene, $C_3$–$C_{30}$ branched alkylene, $C_2$–$C_{30}$ linear alkenylene, $C_3$–$C_{30}$ branched alkenylene, $C_6$–$C_{16}$ arylene, and mixtures thereof; W is selected from the group consisting of $—CO_2^-M^+$, $—SO_3^-M^+$, $—OSO_3^-M^+$; $PO_3^{2-}M^+$, $—OPO_3^-M^+$, $—N^+(R^{27})_3X^-$; $R^{27}$ is independently hydrogen, $C_1$–$C_6$ alkyl, $(CH_2)_nOH$, $—(CH_2CH_2O)_nH$, and mixtures thereof; wherein n is from 1 to 4; M is a water soluble cation of sufficient charge to provide electronic neutrality and X is a water soluble anion.

14. A method for cleaning a stained fabric comprising contacting a stained fabric in need of cleaning with an aqueous cleaning solution comprising at least 0.001 ppm of a photochemical singlet oxygen generator according to claim 1 followed by exposing the surface of the treated fabric to a source of light having a minimal wavelength range from about 300 to about 1200 nanometers.

15. A method for cleaning a hard surface comprising contacting a hard surface in need of cleaning with an aqueous cleaning composition comprising at least 0.01 ppm of a photochemical singlet oxygen generator according to claim 1 and exposing the hard surface to a source of light having a minimal wavelength range from about 300 to about 1200 nanometers.

16. A method for cleaning a stained fabric with a cleaning material comprising a low aqueous cleaning composition comprising contacting a stained fabric in need of stain removal with a low aqueous cleaning solution comprising less than 50% water and at least 0.001 ppm of a photochemical singlet oxygen generator according to claim 1 followed by exposing the surface of the treated fabric to a source of light having a minimal wavelength range from about 300 to about 1200 nanometers.

17. A method for cleaning a hard surface with a low aqueous cleaning composition comprising contacting a hard surface in need of cleaning with a low aqueous cleaning composition comprising less than 50% water and at least 0.001 ppm of a photochemical singlet oxygen generator according to claim 1 and exposing the hard surface to a source of light having a minimal wavelength range from about 300 to about 1200 nanometers.

18. A method for generating superoxide molecules comprising exposing a photochemical singlet oxygen generator according to claim 1 to a source of light having a minimal wavelength of from about 300 to about 1200 nanometers.

* * * * *